US012139245B1

(12) United States Patent
Medower

(10) Patent No.: US 12,139,245 B1
(45) Date of Patent: Nov. 12, 2024

(54) TROLLING MOTOR PONTOON MOUNT

(71) Applicant: Craig Medower, Watertown, MN (US)

(72) Inventor: Craig Medower, Watertown, MN (US)

( * ) Notice: Subject to any disclaimer, the term of this patent is extended or adjusted under 35 U.S.C. 154(b) by 68 days.

(21) Appl. No.: 18/305,345

(22) Filed: Apr. 22, 2023

(51) Int. Cl.
*B63H 20/00* (2006.01)
*B63H 20/02* (2006.01)

(52) U.S. Cl.
CPC ..... *B63H 20/007* (2013.01); *B63H 20/02* (2013.01)

(58) Field of Classification Search
CPC ..... B63H 20/007; B63H 20/02
See application file for complete search history.

(56) References Cited

U.S. PATENT DOCUMENTS 3,604,674 A * 9/1971 Wilkerson ..... B63H 20/007 248/642
3,948,204 A 4/1976 Brock et al.
4,154,417 A 5/1979 Foley, Jr.
5,002,509 A * 3/1991 Uroszek ..... B63H 20/007 440/49
5,005,798 A * 4/1991 McCoy ..... B63H 20/007 248/231.71
5,029,800 A 7/1991 Ponican
5,174,542 A * 12/1992 DeLeeuw, Jr. ..... B63H 20/007 248/225.11
5,542,370 A 8/1996 Castleberry
6,431,923 B1 8/2002 Knight et al.
6,477,969 B2 * 11/2002 Schell-Tomczak .... B63H 20/06 440/49
7,163,427 B1 6/2007 Lee
7,407,419 B2 * 8/2008 Douglas ..... B63H 20/106 440/53
7,722,417 B2 * 5/2010 Bernloehr ..... B63H 20/08 440/55
7,887,381 B2 2/2011 Brass et al.
7,972,188 B2 7/2011 Bernloehr et al.
8,684,328 B2 * 4/2014 Mynster ..... B63H 20/08 248/231.51
9,248,897 B2 2/2016 Shields
9,296,455 B2 3/2016 Bernloehr et al.
9,623,944 B2 4/2017 Kuehmichel et al.
9,889,914 B1 2/2018 Ostrowsky
9,914,519 B2 3/2018 Nutz et al.
11,097,823 B1 * 8/2021 Boks ..... B63H 20/007
11,932,366 B1 * 3/2024 Nyren ..... B63B 3/48
2003/0194921 A1 * 10/2003 Leiss ..... B63H 20/06 440/6
2004/0110431 A1 6/2004 Dunn
2014/0014810 A1 1/2014 Brown
2016/0023738 A1 1/2016 Monahan
2016/0159437 A1 6/2016 Pappas et al.
2018/0057130 A1 * 3/2018 Houle ..... B63H 5/20
2022/0315189 A1 * 10/2022 Hunziker, II ..... B63H 20/06

* cited by examiner

*Primary Examiner* — Monica E Millner
(74) *Attorney, Agent, or Firm* — Dietz Law Office LLC

(57) ABSTRACT

A trolling motor secondary mount for mounting a trolling motor to the squared off bow of a boat such as a pontoon. The secondary mount allows the trolling motor to be stored in a travelling or stowed position wherein the lengthwise shaft of the trolling motor aligns parallel with the squared off end of the bow, while the primary trolling motor mount allows the trolling motor to be rotated into the water at a mid portion of the bow of the boat.

10 Claims, 23 Drawing Sheets

TROLLING MOTOR PONTOON MOUNT

CROSS-REFERENCE TO RELATED APPLICATIONS

Not Applicable.

FEDERALLY SPONSORED RESEARCH AND DEVELOPMENT

Not Applicable.

JOINT RESEARCH AGREEMENT

Not Applicable.

TECHNICAL FIELD

This invention pertains generally to secondary mounts for a boat's trolling motor. More specifically, this invention pertains to a trolling motor secondary mount for mounting a trolling motor to the squared off bow of a boat such as a pontoon or tri-toon. The secondary mount allows the trolling motor to be stored in a travelling or stowed position wherein the lengthwise shaft of the trolling motor aligns parallel with the squared off end of the bow, while the primary trolling motor mount allows the trolling motor to be rotated into the water at a mid-section of the front squared off end of the boat.

BACKGROUND

Over the years various trolling motors have been mounted to the sides and bow of fishing boats. When mounting a trolling motor to a V-hull, the trolling motor must be mounted so that the trolling motor rotates into the water off a side of the V rather than off the apex of the V to avoid blocking visibility of the navigation lights. V-hull boats have a navigation light mounted in the apex of the bow, so that oncoming boats are able to identify the front of the boat and the direction of travel. Unlike V-hull boats, other boats such as pontoons and tri-toons have a squared off front end, requiring separate navigation lights mounted on the two front corners of the boat deck. In contrast, when utilizing a trolling motor on a pontoon or tri-toon boat, for example, it is desirable to rotate the trolling motor into the water from a front mid portion of the squared off front deck.

Trolling motors typically include a long drive shaft that is rotationally mounted to allow the user to rotate the propeller and shaft into the water for trolling and rotate out of the water when boating across the lake from one location to another. When the trolling motor is rotated out of the water into the stored position, the weight of the propeller housing and the distance of the propeller housing from the trolling motor mount requires a significantly rigid mount to withstand the torques applied to the mount when the propeller housing bounces as the boat travels over waves. Out of necessity, the trolling motor mount is typically rigid and only allows rotation of the trolling motor shaft through a single plane. This two-dimensional rotation limits the locations and options for mounting the trolling motor mount to a boat.

Previously, when a trolling motor was mounted to the squared off front end of a boat, the axis of rotation of the drive shaft rotated along the length axis of the deck in order to be able to rotate the propeller housing into and out of the water off the front end of the deck. When mounted to the front end of a pontoon boat, for example, the orientation of the trolling motor in a stored position, would require extending the trolling motor control and shaft into the pontoon boat. Thus, a front gate of the pontoon boat was opened and the walkway blocked when the trolling motor was rotated into the stored position. Also, when fastened to the pontoon deck, at least a portion of the prior trolling motor mounts extend out past the front squared off end of the boat which interferes with the front bumper or support members of a pontoon trailer. Thus, a need exists for a secondary trolling motor mount that allows the trolling motor to be stored in a travelling or stowed position wherein the lengthwise shaft of the trolling motor aligns parallel with and above the squared off end of the bow, while the primary trolling motor mount allows the trolling motor to be rotated into the water off the front mid-section of the pontoon deck.

SUMMARY

Embodiments according to aspects of the invention provide a secondary mounting system for a boat trolling motor mount which is particularly useful on any boat or water vessel having a squared off front end. Without limitation intended, reference is made throughout to pontoon boats or tri-toons, which are exemplary water vessels having squared off front ends. The secondary mount of the present invention allows the trolling motor to be stored in a travelling or stowed position above the deck in a parallel orientation to the squared off front portion of the bow of the boat. The length of the drive shaft of the trolling motor aligns parallel with the squared off end of the bow, rather than extending into the interior of the pontoon. The secondary mount further allows the primary trolling motor mount to rotate the trolling motor drive shaft into the water from the front mid portion of the pontoon bow or deck.

The secondary mount includes a base plate, a deck plate, a backing plate, and a rotation locking mechanism. A portion of the base plate is mounted to the underside of a trolling motor mount while an opposing end portion of the base plate is rotationally attached or otherwise coupled to the deck plate. The base plate is adapted for fixing to a bottom of a trolling motor mount, whereby a longitudinal axis of the base plate is aligned perpendicular to a length axis of the trolling motor mount. The deck plate is adapted to attach to a top front mid-portion of the deck of a pontoon boat. The backing plate is oriented under the deck of the pontoon boat, beneath the deck plate, whereby the backing plate is adapted to couple to the deck plate (with the deck of the pontoon sandwiched in between the two plates). Associated with the deck plate is a first member adapted for locking a top planar surface of the base plate in a horizontal position relative to the deck plate and a second member adapted for locking the top planar surface of the base plate in a vertical position relative to the deck plate.

In certain embodiments in accordance with aspects of the invention, described in greater detail in the detailed description, the deck plate may be comprised of two spaced apart angle plate having a vertically oriented plate and horizontally oriented plate rigidly mounted to one of the angle plates. The locking mechanism is mounted to the base plate and includes a spring actuated plunger or rod that engages with the horizontal and vertical oriented plates. The horizontal and vertical oriented plates include an aperture into which a tip of the lock mechanism engages. The lock mechanism may include a quick release lever that is adapted to engage and disengage with the first and second plates or members. Those skilled in the art will appreciate that a single, unitary plate may include a milled out pocket or cavity into which the rotation end of the base plate inserts. Apertures extend into side walls of the pocket or cavity and are spaced apart to engage the tip of the quick release lever when the base plate is rotated into the horizontal or vertical position. The top of this rigid plate defines the planar surface of the deck plate. The opposing sidewalls of the cavity slidingly engage with the opposing sides of the base plate.

Embodiments in accordance with this aspect of the invention may further include a cover that at least partially encloses the deck plate, first member, second member, and quick release lever. The cover is preferably fixed to the deck plate with hinges to allow user access to the quick release lever. Also, the deck plate may be rotationally coupled to the base plate with a quick disconnect rotation pin. Further, the quick release lever may be spring actuated to keep the tip of the pin engaged within an aperture of the deck plate.

In accordance with certain aspects of the invention, an embodiment of the invention includes a method of mounting a trolling motor to the bow of a pontoon boat such that when the trolling motor is positioned in the stored position the length of the drive shaft of the trolling motor aligns parallel with the squared off end of the bow, rather than extending into the interior of the pontoon. The method utilizes a secondary mount that includes a base plate adapted for mounting to a bottom of a trolling motor mount, whereby a longitudinal axis of the base plate is aligned perpendicular to a length axis of the trolling motor mount; a deck plate rotationally coupled to the base plate, wherein the deck plate is adapted to attach to a deck of a pontoon boat; a backing plate oriented under the deck of the pontoon boat, whereby the backing plate is adapted to couple to the deck plate; a first member adapted for locking a top planar surface of the base plate in a horizontal position relative to the deck plate; a second member adapted for locking the top planar surface of the base plate in a vertical position relative to the deck plate; and a quick release lever that is adapted to engage and disengage with the first and second members.

The method includes the steps of obtaining a trolling motor having a mounting base that includes a first section having a longitudinal axis wherein the first section mounts to a boat and a second section having a longitudinal axis, wherein the first section and section are rotationally coupled such that the longitudinal axis of the second plate rotates along the longitudinal axis of the first section; obtaining a secondary mount apparatus for a trolling motor mount; mounting the deck plate of the secondary mount apparatus to the bow of the pontoon boat; and mounting the first section of the mounting base of the trolling motor to the base plate of the secondary mount apparatus whereby the longitudinal axis of the first section of the mounting base of the trolling motor is aligned perpendicular to the longitudinal axis of the base plate.

In accordance with certain embodiments of the invention the method may further include the step of mounting a cover to the deck plate whereby the cover at least partially encloses the deck plate, first member, second member, and quick release lever. Additionally, the method may include the step of rotationally coupling the deck plate to the base plate with a quick disconnect rotation pin. Also, the method may include the step of utilizing a spring actuated quick release lever. Further the method may include the step of sandwiching the deck of the pontoon between the deck plate and backing plate.

Once the trolling motor is mounted to the base plate, the user may disengage the quick release lever to rotate the base plate between the stowed position and boating position. When in the boating position, a portion of the base plate extends out past the front edge of the squared off front of the pontoon boat. The trolling motor shaft is elevated above the water in a horizontal position beyond the front walkway of the pontoon. In this manner, the trolling motor may be oriented out of the water without extending into the boat deck area. The trolling motor may be rotated and lowered to position the trolling motor propeller housing in the water.

The accompanying drawings, which are incorporated in and constitute a portion of this specification, illustrate embodiments of the invention and, together with the detailed description, serve to further explain the invention. The embodiments illustrated herein are presently preferred; however, it should be understood, that the invention is not limited to the precise arrangements and instrumentalities shown. For a fuller understanding of the nature and advantages of the invention, reference should be made to the detailed description in conjunction with the accompanying drawings.

DESCRIPTION OF THE DRAWINGS

In the various figures, which are not necessarily drawn to scale, like numerals throughout the figures identify substantially similar components.

DETAILED DESCRIPTION

Figure 1:
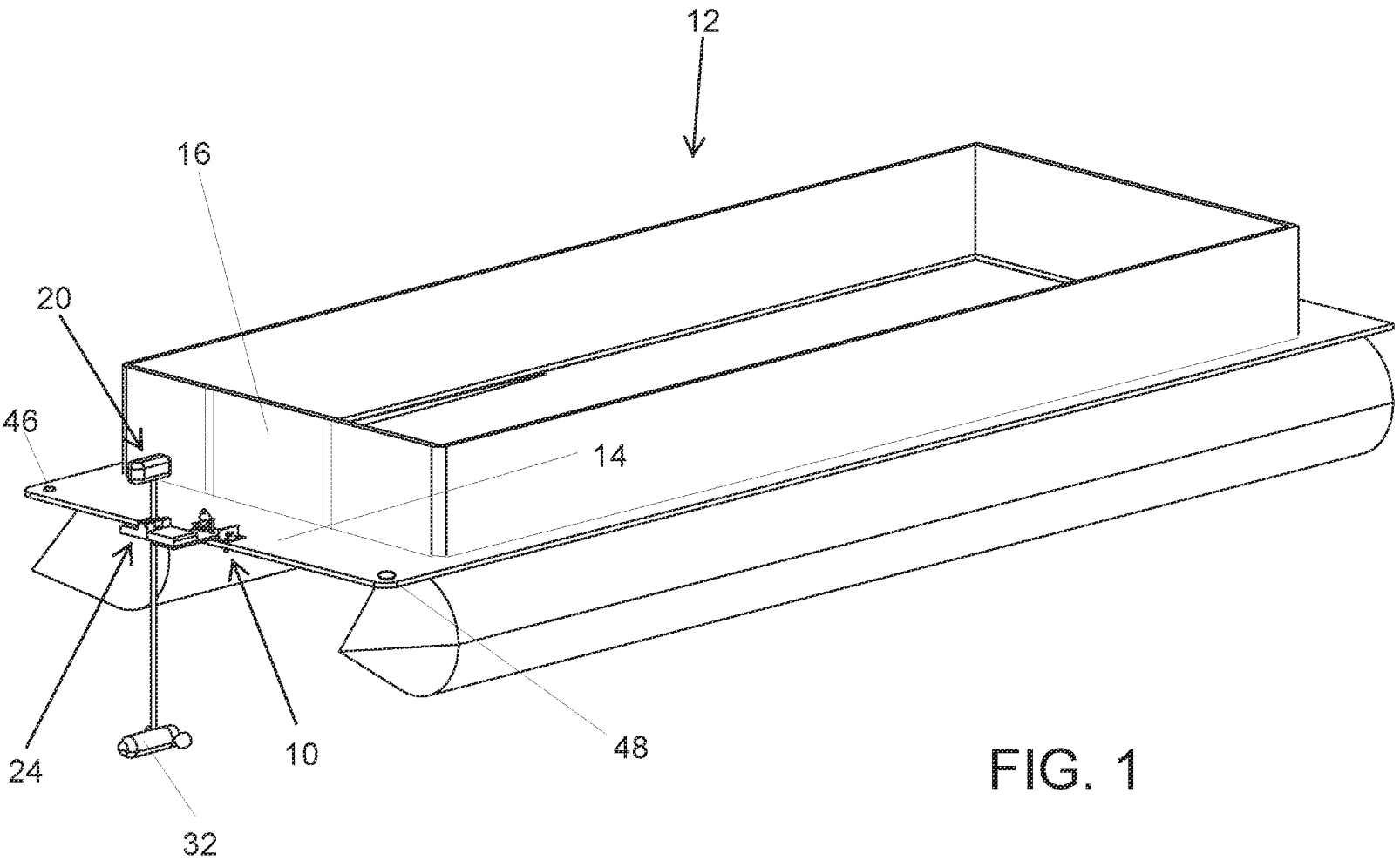
FIG. 1 is a front perspective view of a pontoon boat having a trolling motor mount attached to a secondary mount that is fixed to a deck of the pontoon boat in accordance with aspects of the present invention.

The following description provides detail of various embodiments of the invention, one or more examples of which are set forth below. Each of these embodiments are provided by way of explanation of the invention, and not intended to be a limitation of the invention. Further, those skilled in the art will appreciate that various modifications and variations may be made in the present invention without departing from the scope or spirit of the invention. By way of example, those skilled in the art will recognize that features illustrated or described as part of one embodiment, may be used in another embodiment to yield a still further embodiment. Thus, it is intended that the present invention also cover such modifications and variations that come within the scope of the appended claims and their equivalents.

The trolling motor secondary mount 10 of the present invention provides a mount and method to attach a trolling motor 20 to the front squared off bow of a boat 12 such that the trolling motor 20 may be stored in a travelling or stowed position wherein the lengthwise shaft 22 of the trolling motor 20 aligns parallel with and above the squared off end 14 of the bow, and may be rotated out over the front end of the bow so that the trolling motor primary mount 24 allows the trolling motor 20 to be rotated into the water. Those skilled in the art will recognize that several types of boats exist having squared off front ends that could benefit from the secondary mount of the present invention. For purposes of discussion, and by way of example without limitation intended, a pontoon boat will be described with reference to the mounting and use of the secondary trolling motor mount.

Figure 2:
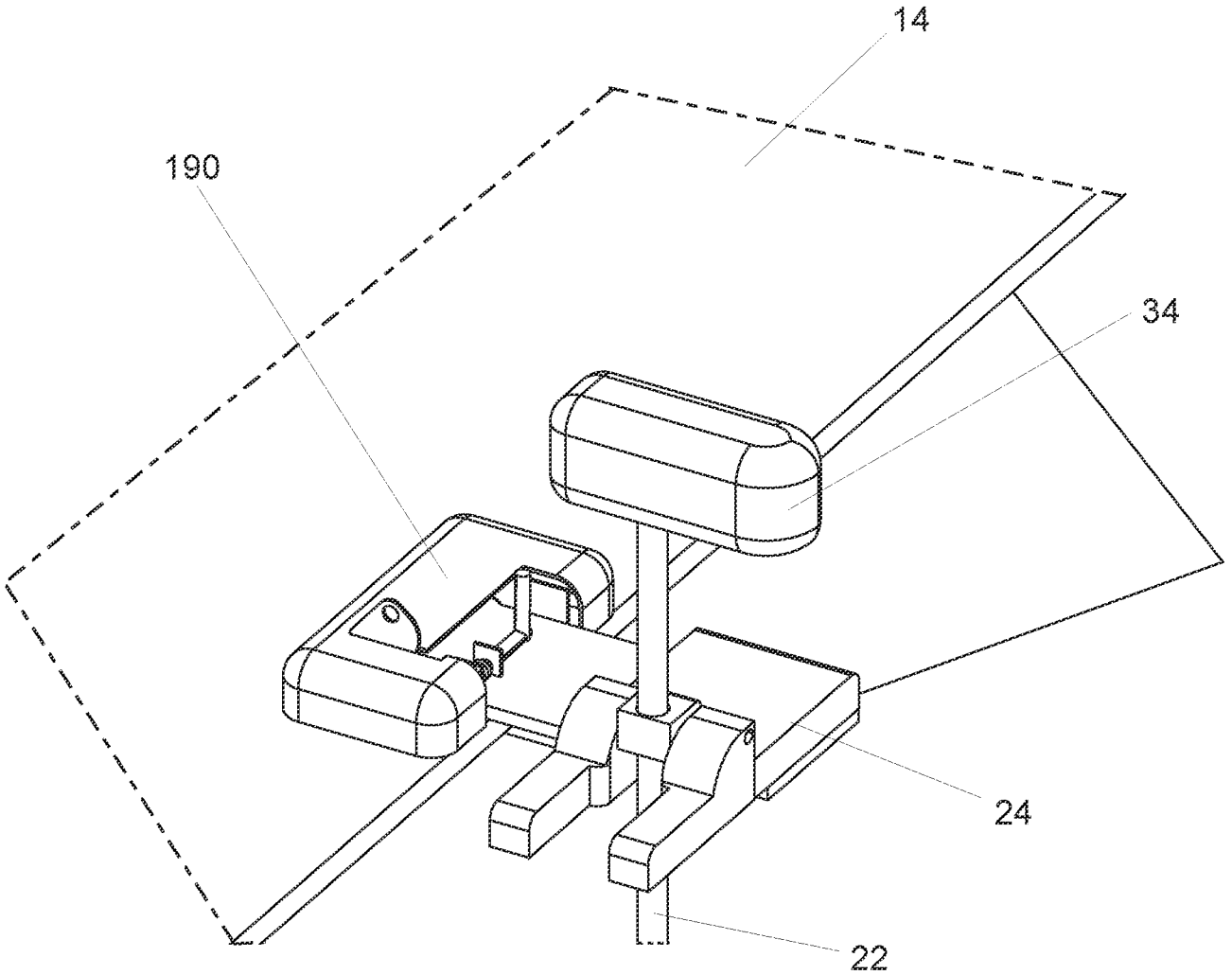
FIG. 2 is a partial sectional front perspective view of a pontoon boat having a trolling motor mount attached to a secondary mount that is fixed to a deck of the pontoon boat in accordance with aspects of the present invention.
Figure 3:
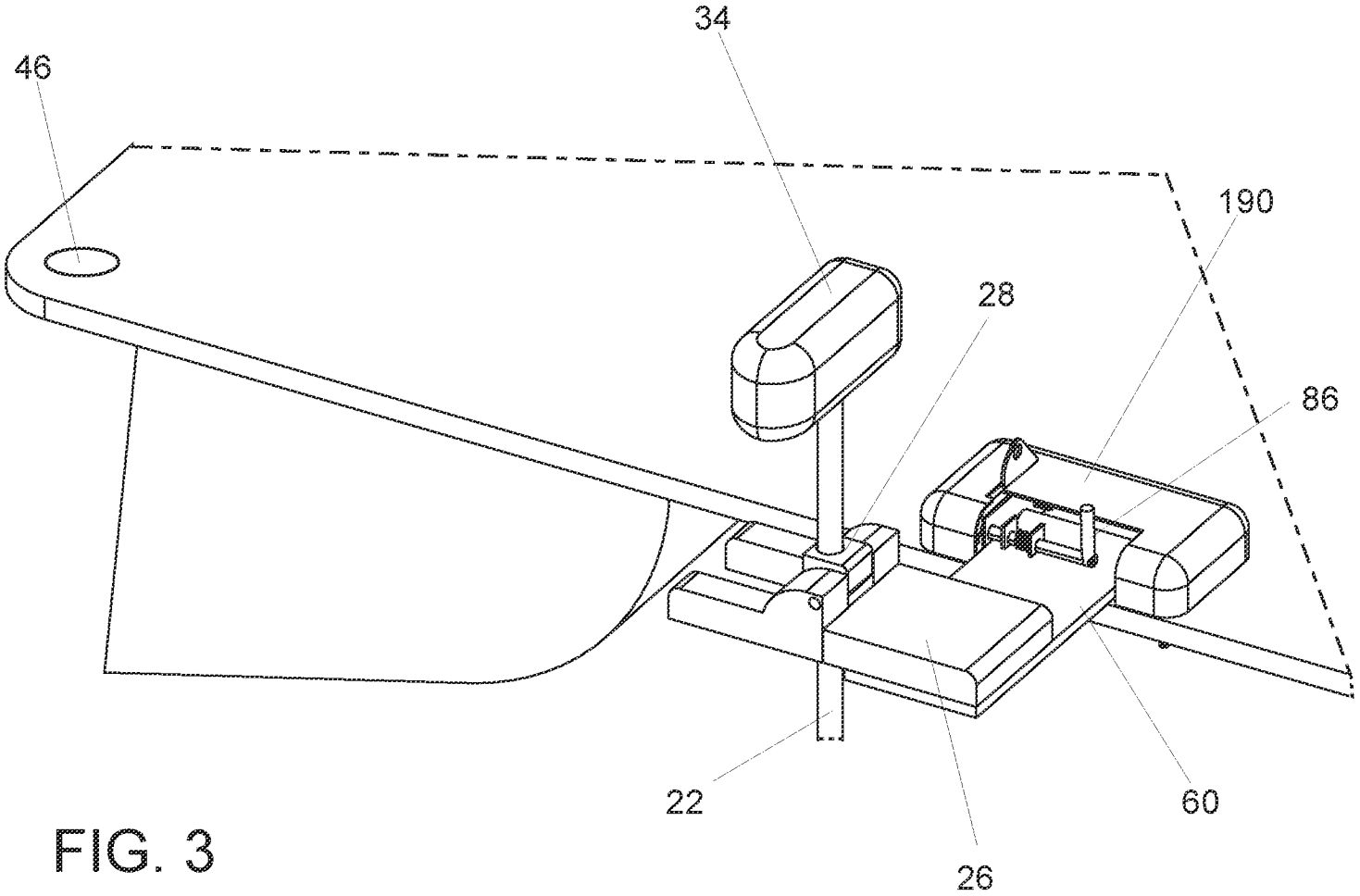
FIG. 3 is a partial sectional front perspective view of a pontoon boat having a trolling motor mount attached to a secondary mount that is fixed to a deck of the pontoon boat in accordance with aspects of the present invention.
Figure 4:
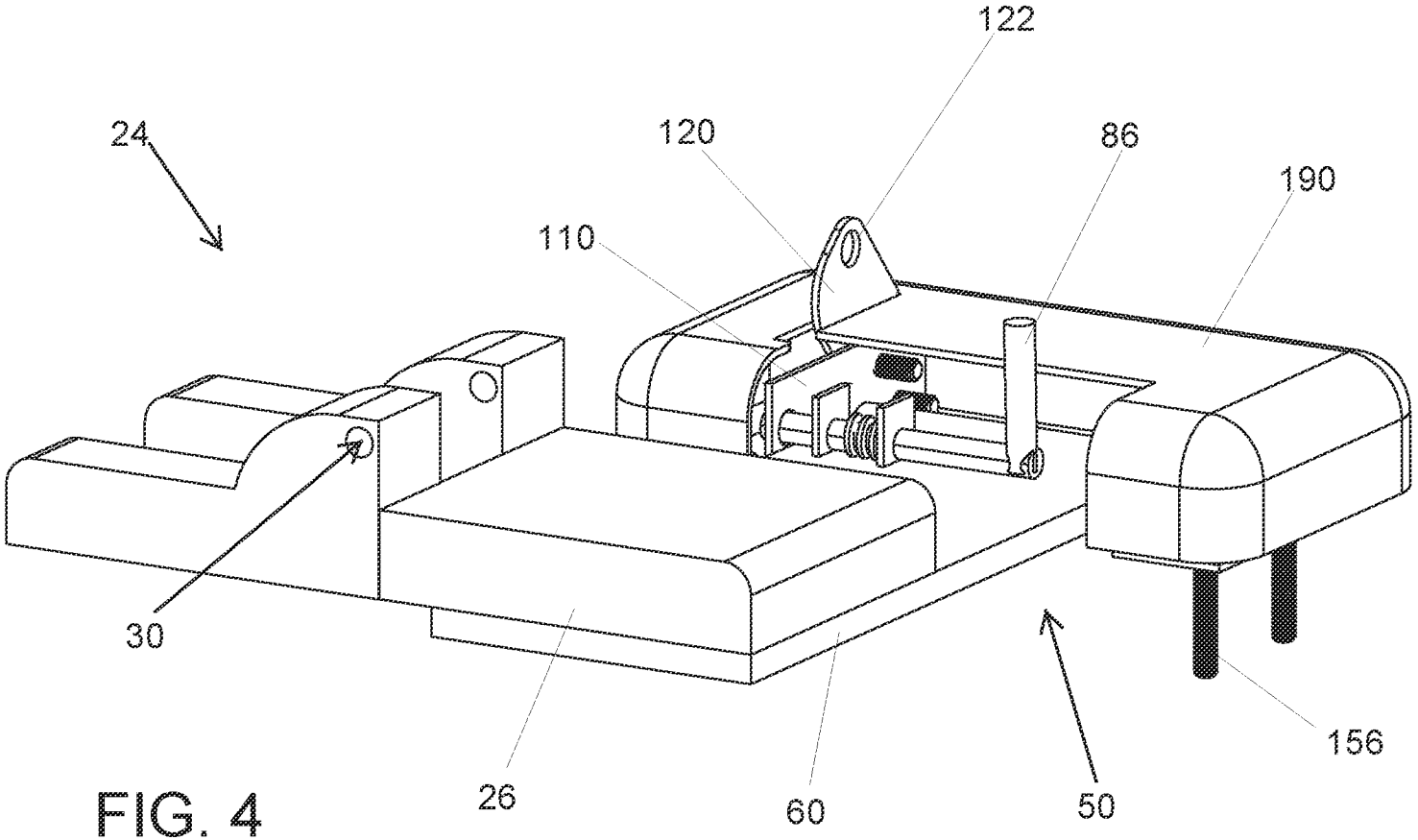
FIG. 4 is a perspective view of a portion of trolling motor mount attached to a base plate of a secondary mount in accordance with aspects of the present invention.
Figure 5:
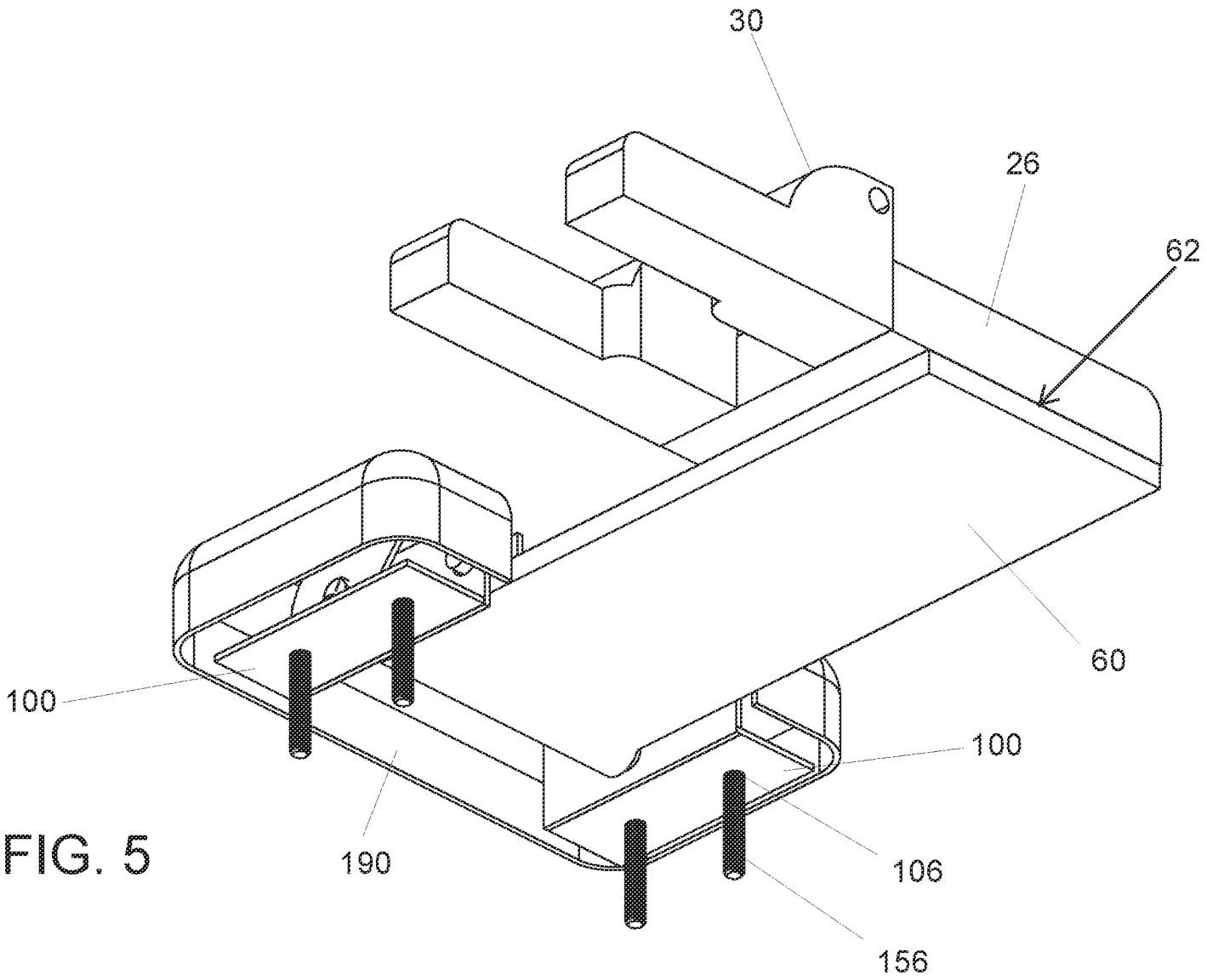
FIG. 5 is a bottom perspective view of a portion of trolling motor mount attached to a base plate of a secondary mount in accordance with aspects of the present invention.
Figure 6:
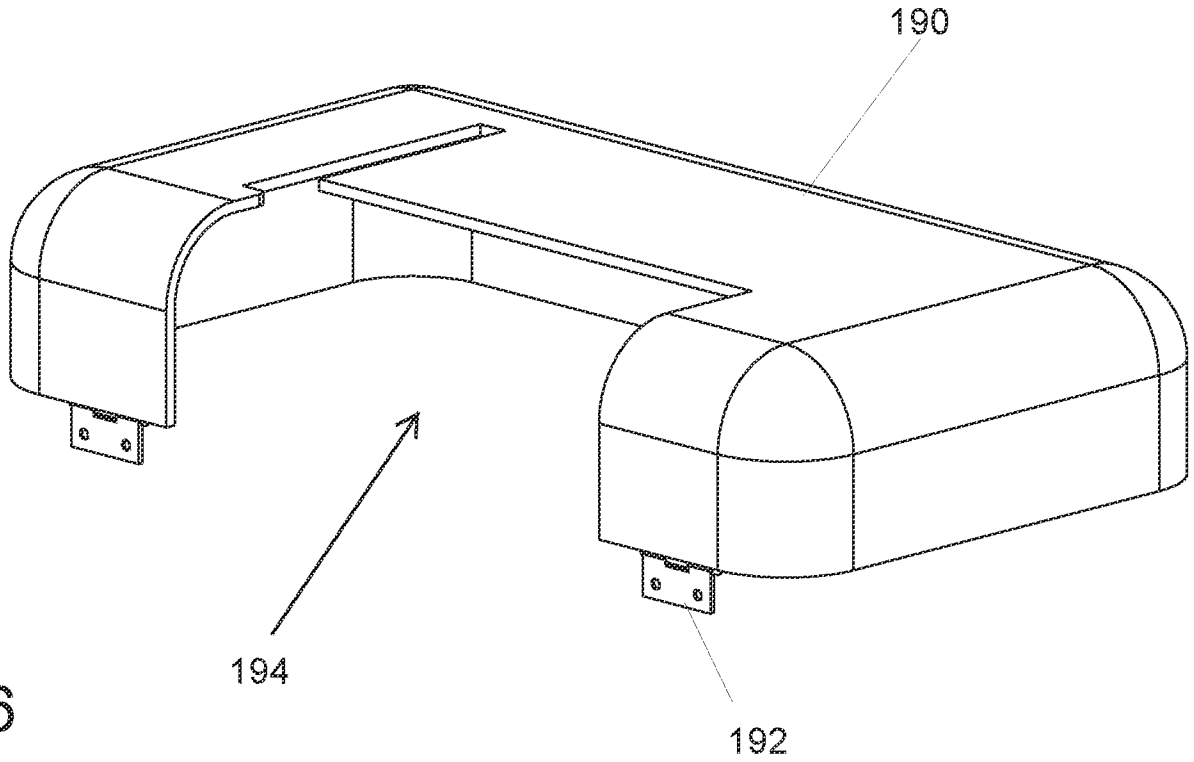
FIG. 6 is a top perspective view of a cover of the secondary mount in accordance with the present invention.
Figure 7:
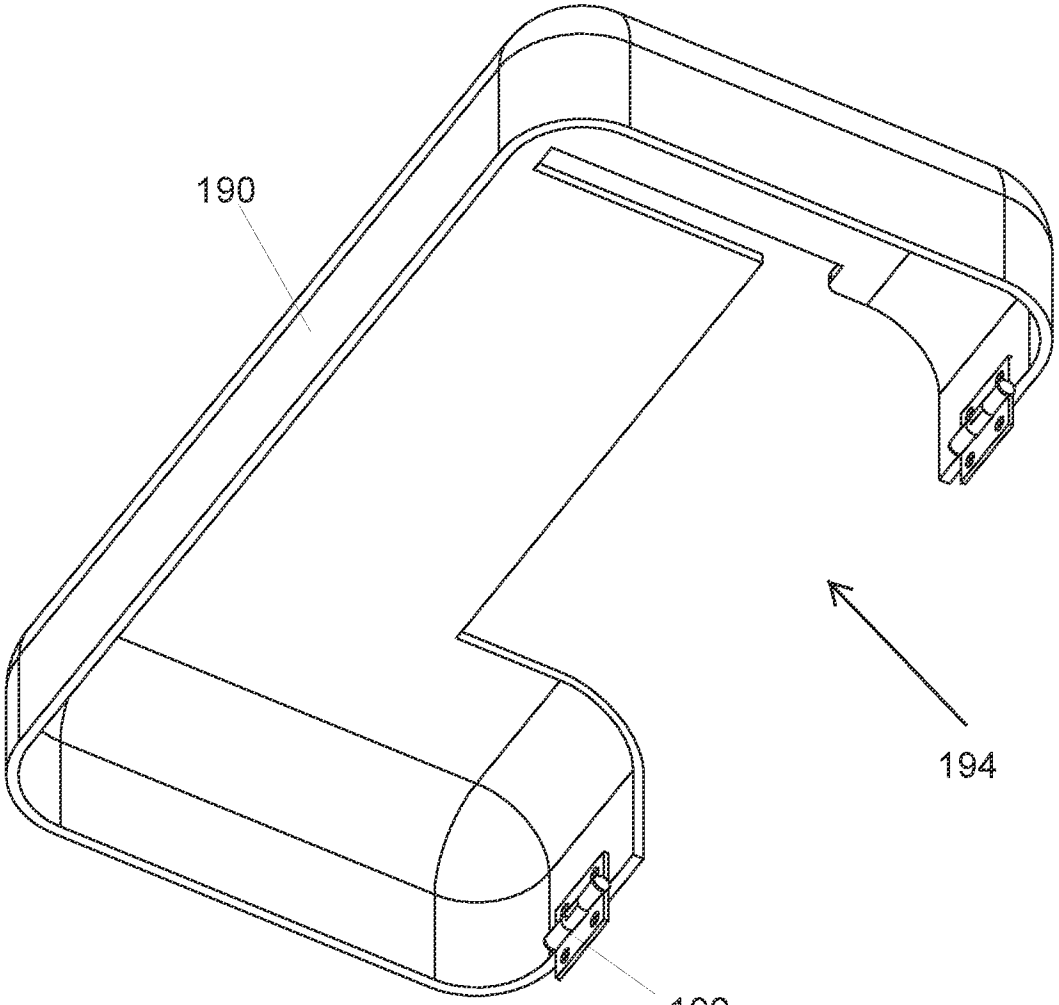
FIG. 7 is a bottom perspective view of a cover of the secondary mount in accordance with the present invention.
Figure 8:
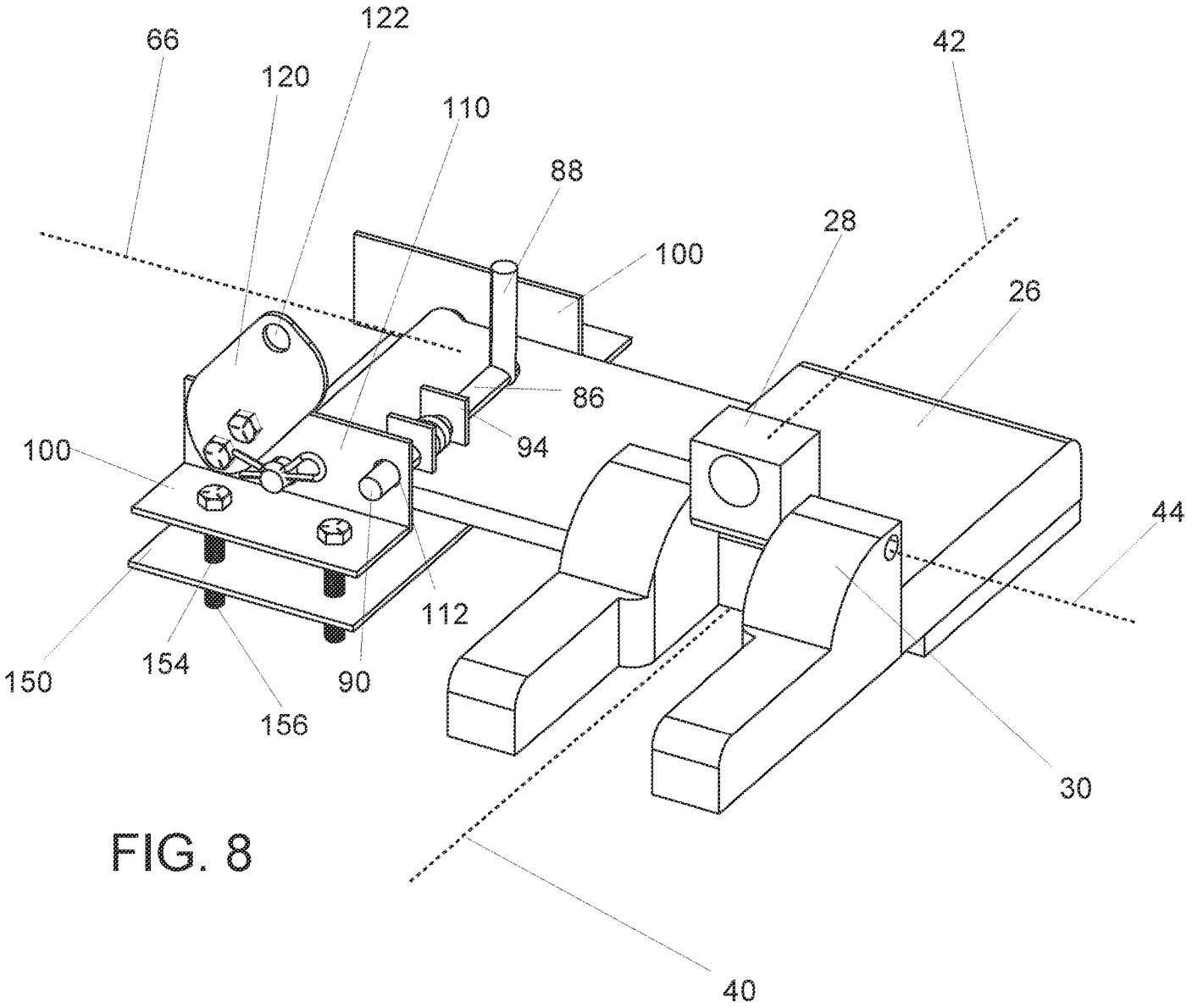
FIG. 8 is a perspective view of the pontoon trolling motor secondary mount in accordance with the present invention shown with a cover removed.
Figure 9:
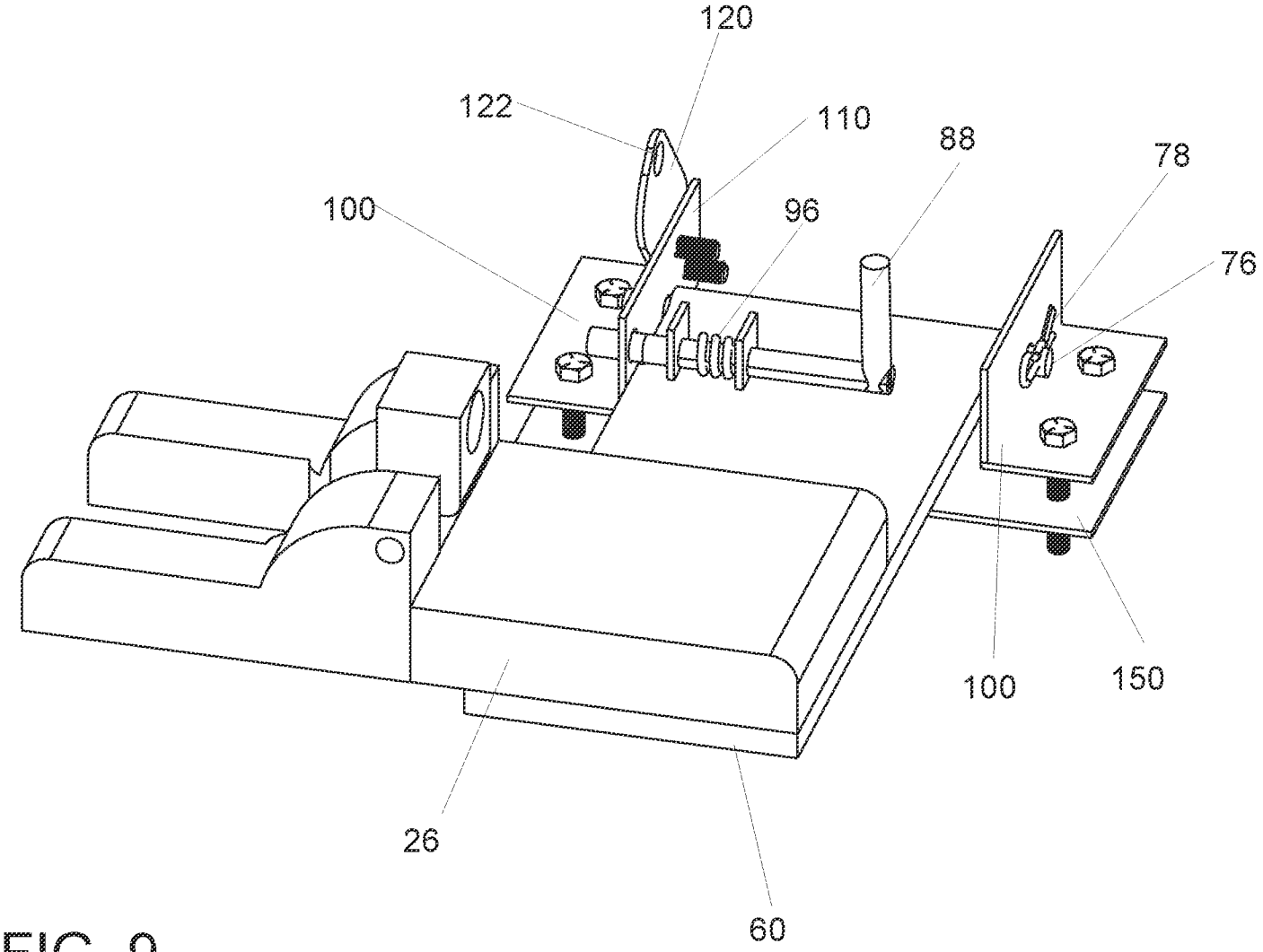
FIG. 9 is a top front perspective view of the pontoon trolling motor secondary mount in accordance with the present invention shown with a cover removed.
Figure 10:
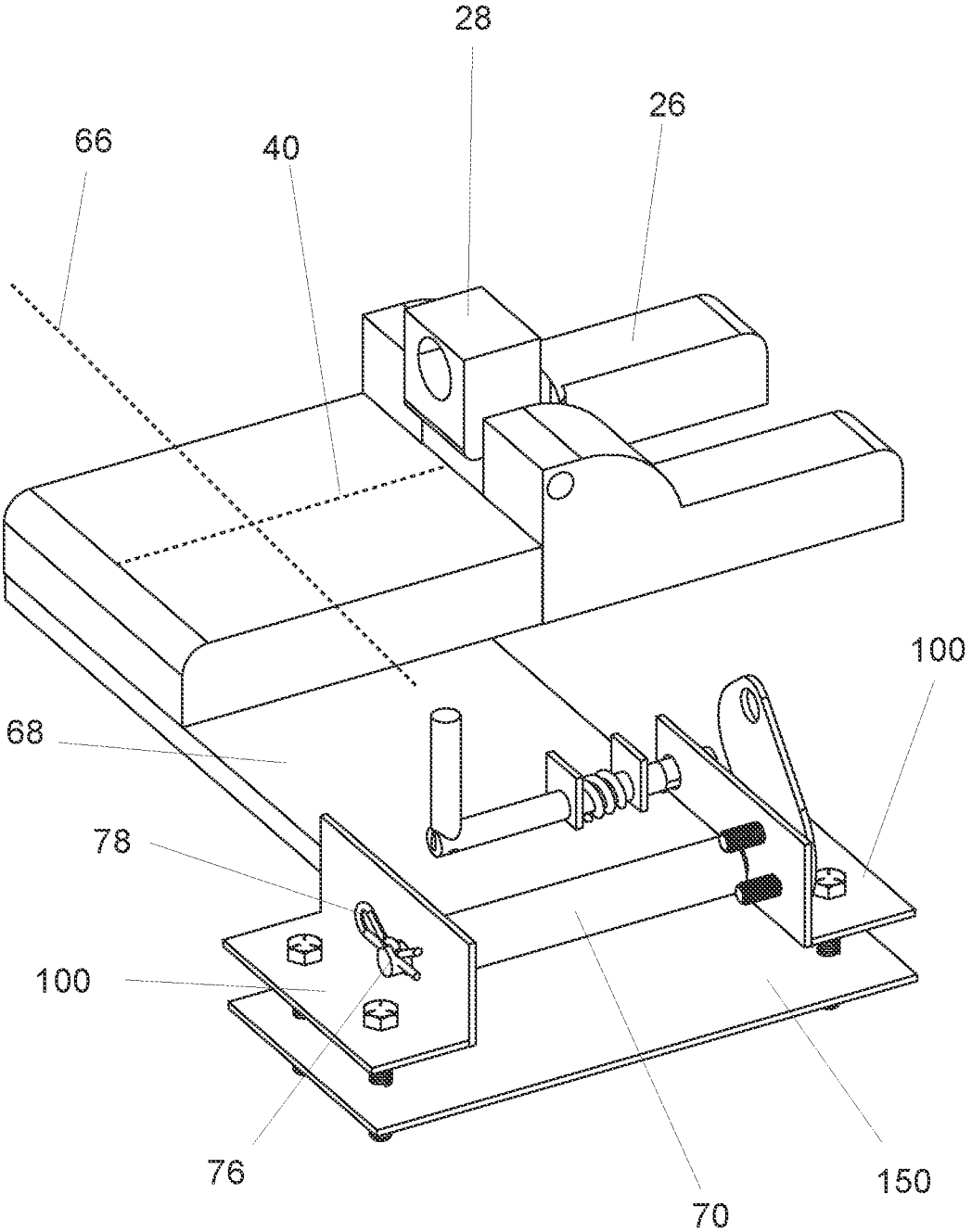
FIG. 10 is a top back perspective view of the pontoon trolling motor secondary mount in accordance with the present invention shown with a cover removed.
Figure 11:
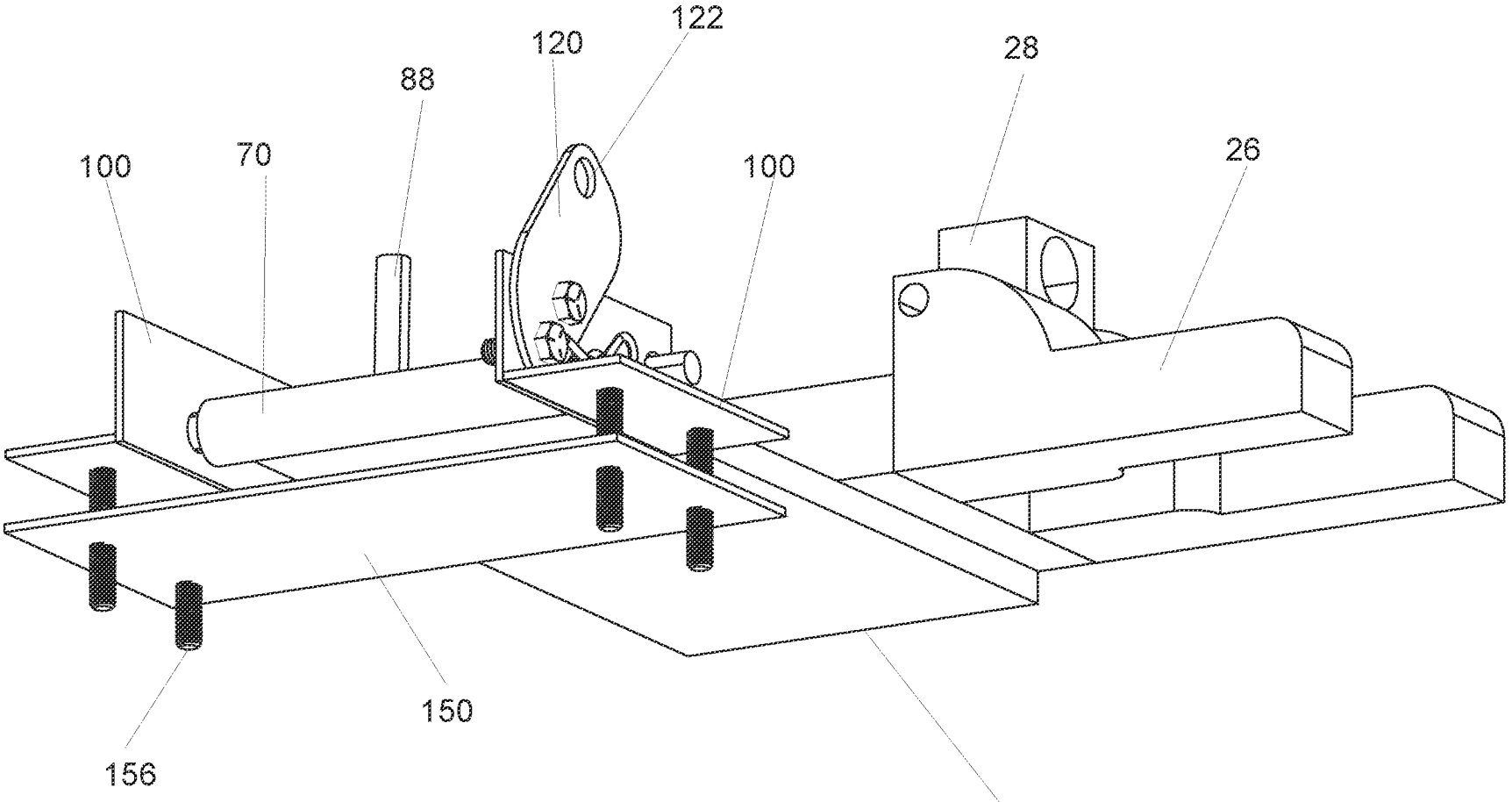
FIG. 11 is a bottom perspective view of the pontoon trolling motor secondary mount in accordance with the present invention shown with a cover removed.
Figure 12:
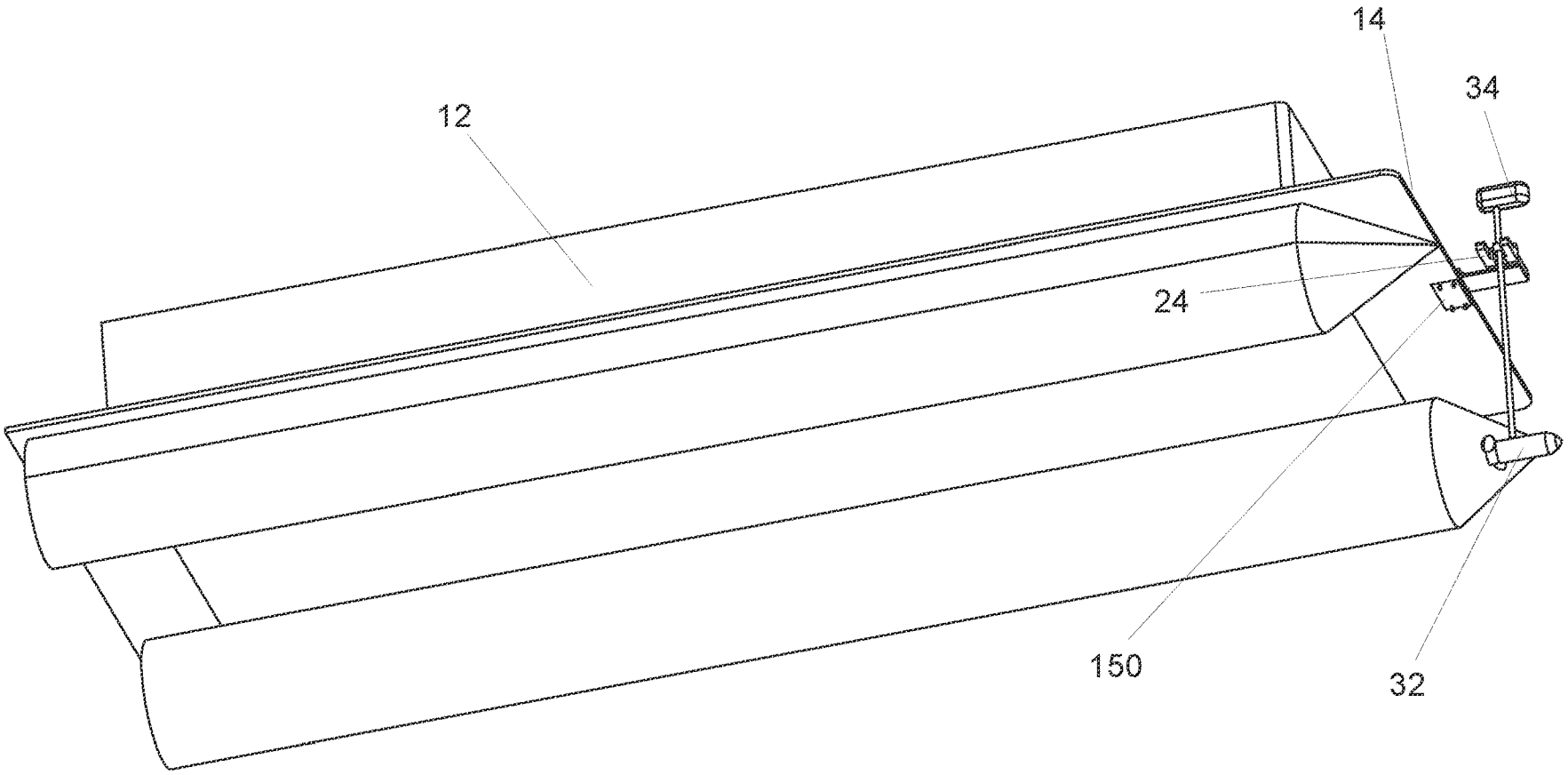
FIG. 12 is a bottom side perspective view of a pontoon boat having a trolling motor mount attached to a secondary mount that is fixed to a deck of the pontoon boat in accordance with aspects of the present invention and illustrating the trolling motor oriented in the trolling position.
Figure 13:
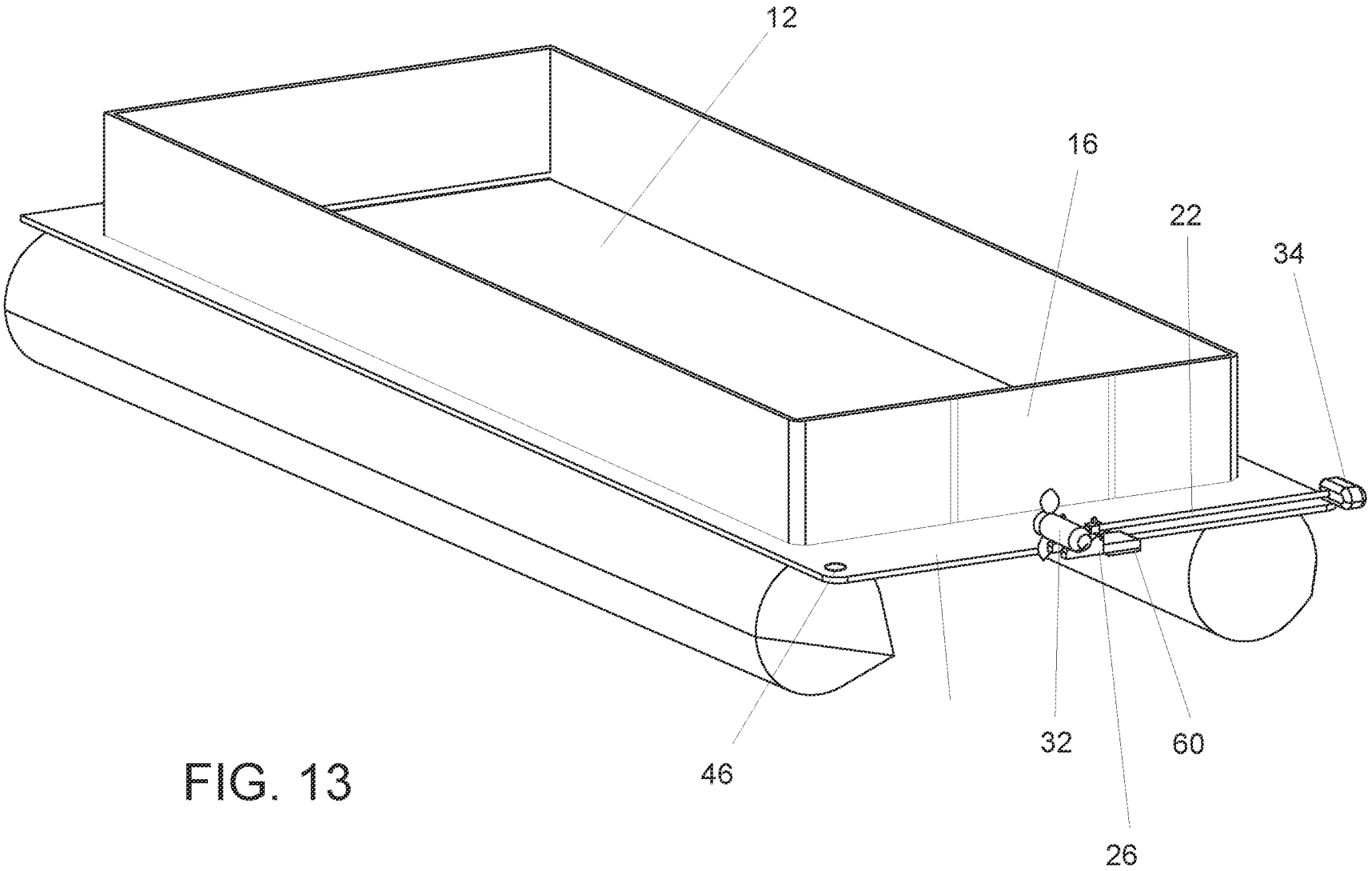
FIG. 13 is a top front perspective view of a pontoon boat having a trolling motor mount attached to a secondary mount that is fixed to a deck of the pontoon boat in accordance with aspects of the present invention and illustrating the trolling motor orientation when changing locations on a lake.
Figure 14:
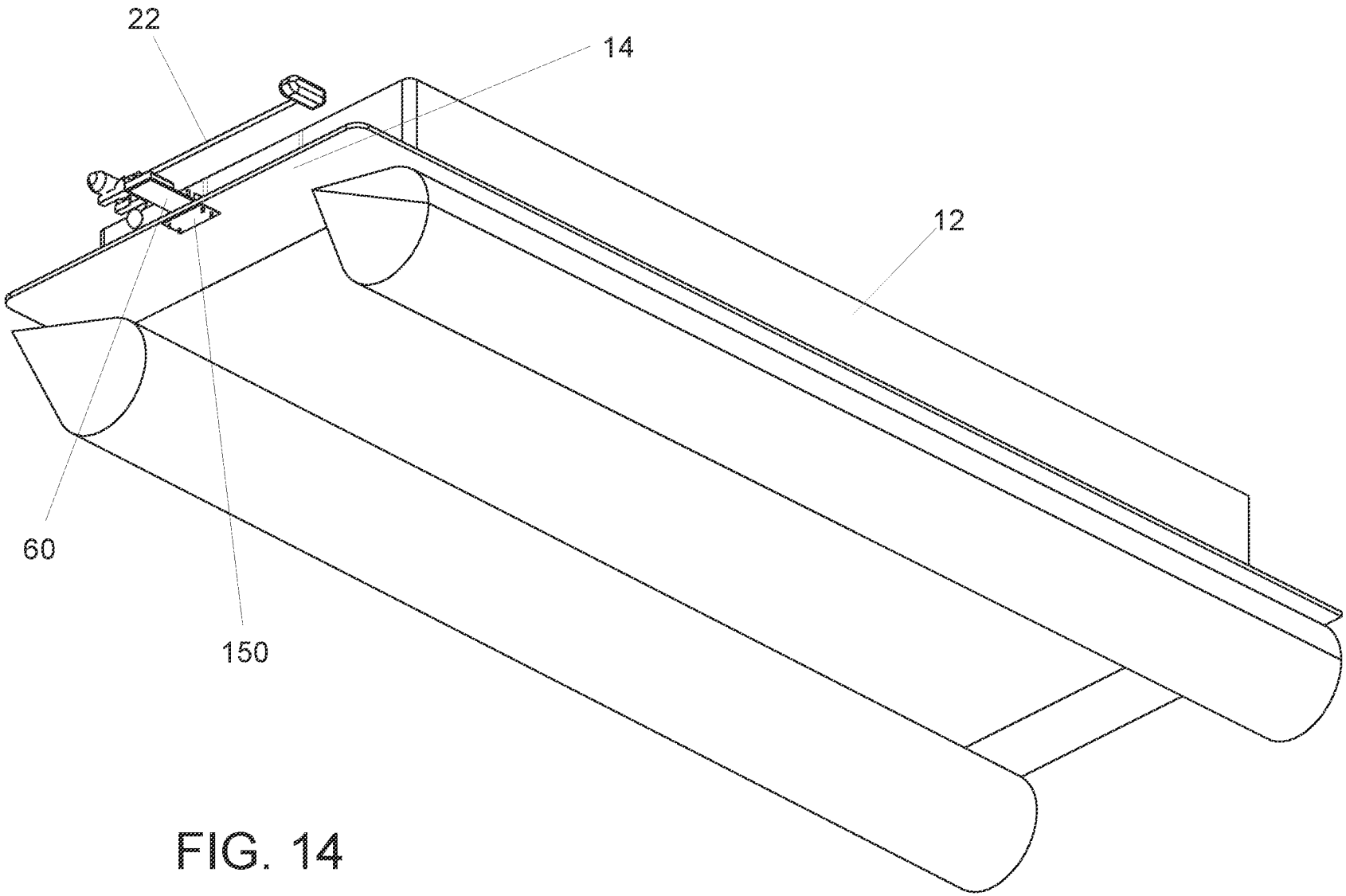
FIG. 14 is a bottom front perspective view of a pontoon boat having a trolling motor mount attached to a secondary mount that is fixed to a deck of the pontoon boat in accordance with aspects of the present invention and illustrating the trolling motor orientation when changing locations on a lake.
Figure 15:
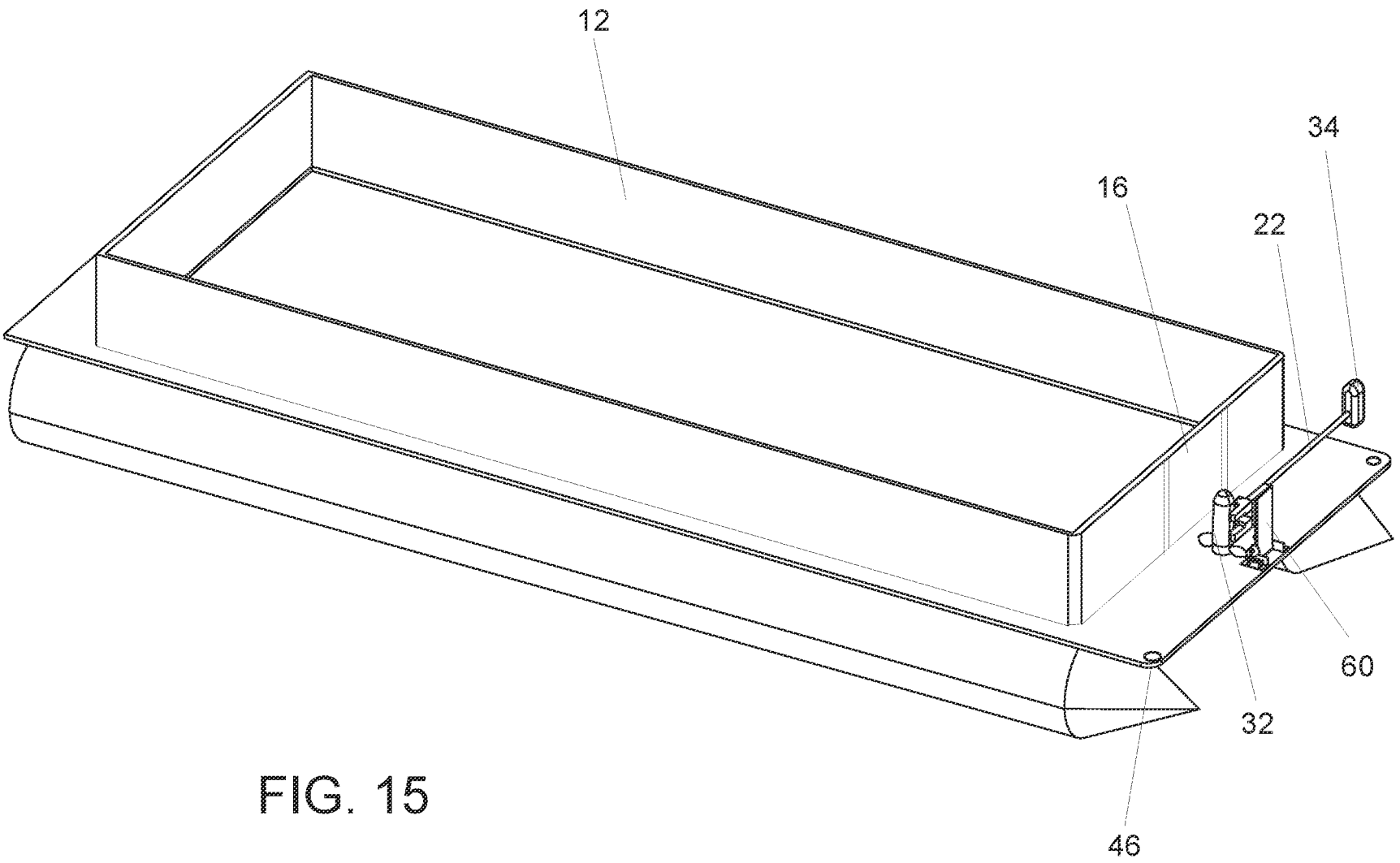
FIG. 15 is a side perspective view of a pontoon boat having a trolling motor mount attached to a secondary mount that is fixed to a deck of the pontoon boat in accordance with aspects of the present invention and illustrating the trolling motor orientation when trailering the pontoon boat.
Figure 16:
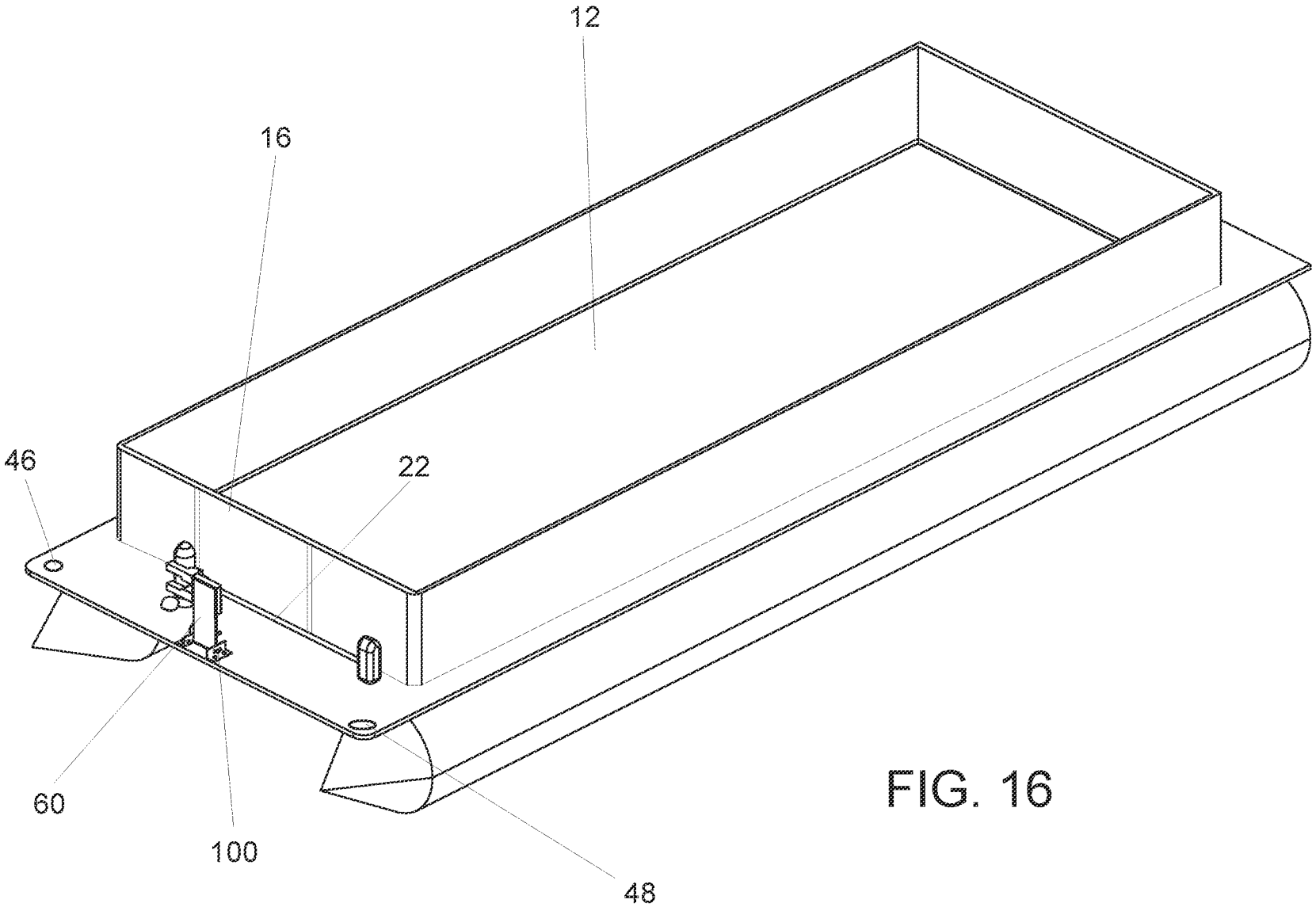
FIG. 16 is a front top perspective view of a pontoon boat having a trolling motor mount attached to a secondary mount that is fixed to a deck of the pontoon boat in accordance with aspects of the present invention and illustrating the trolling motor orientation when trailering the pontoon boat.
Figure 17:
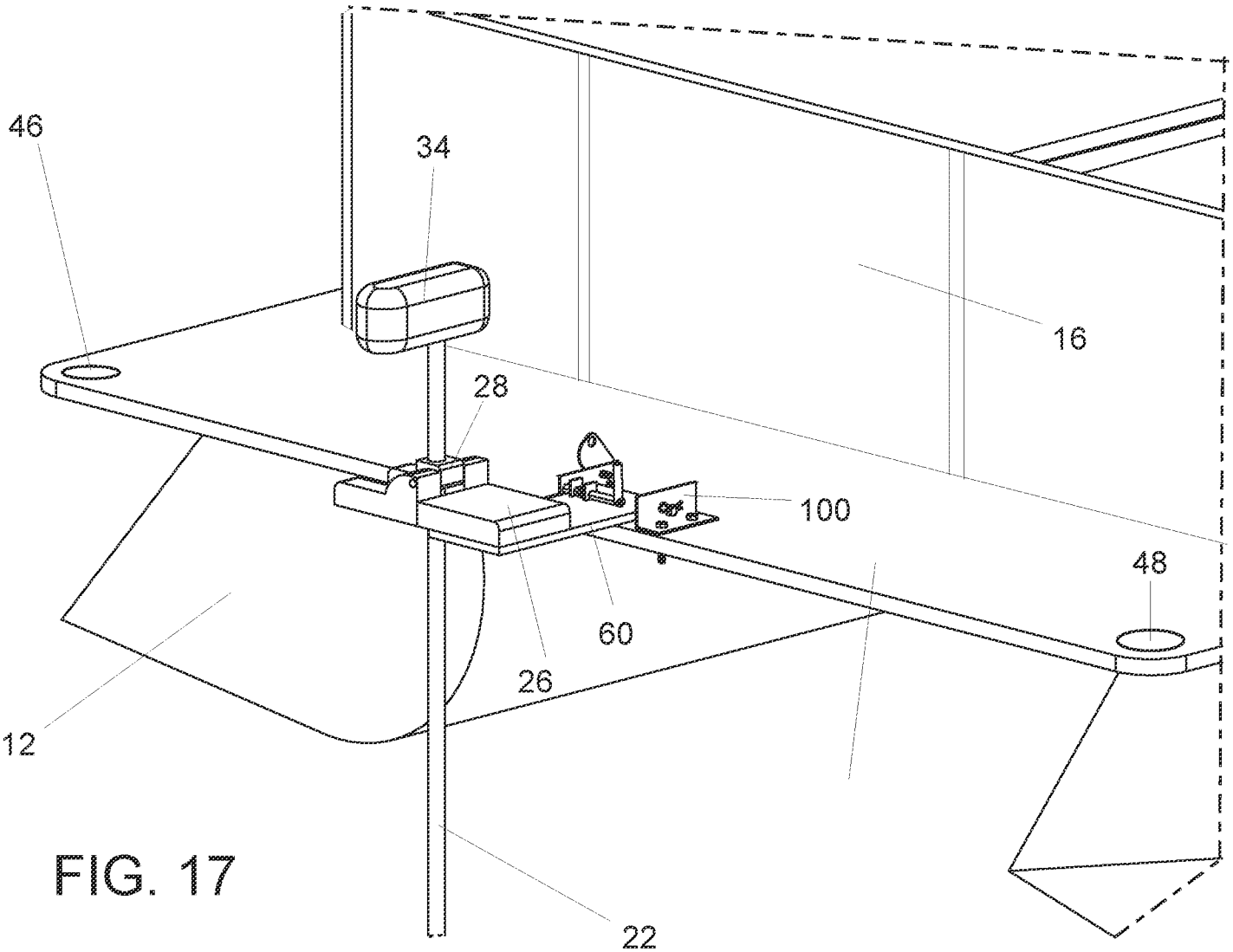
FIG. 17 is a partial sectional front perspective view of a pontoon boat having a trolling motor mount attached to a secondary mount that is fixed to a deck of the pontoon boat in accordance with aspects of the present invention and illustrating the trolling motor oriented in the trolling position.
Figure 18:
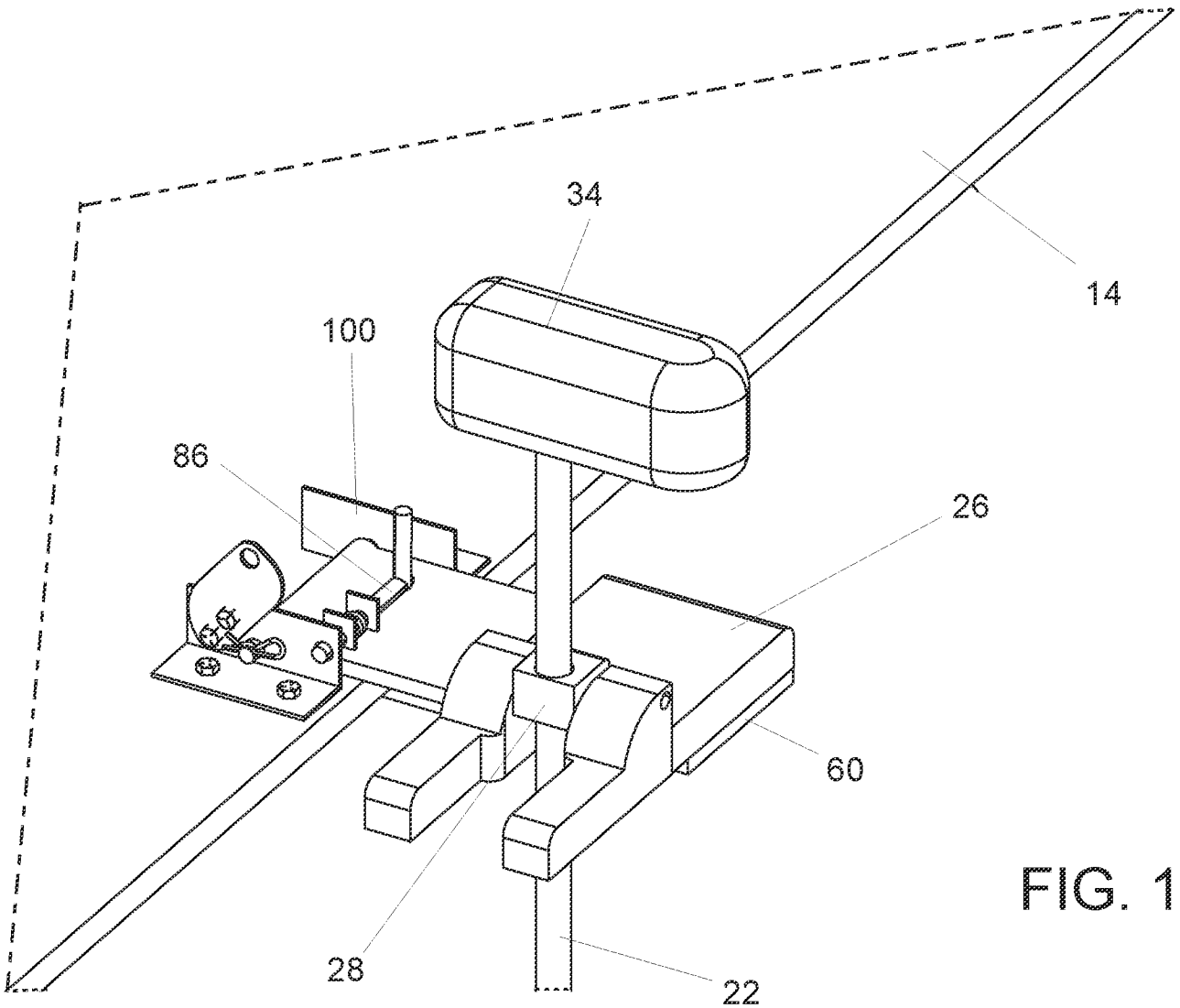
FIG. 18 is a partial sectional front perspective view of a pontoon boat having a trolling motor mount attached to a secondary mount that is fixed to a deck of the pontoon boat in accordance with aspects of the present invention and illustrating the trolling motor oriented in the trolling position.
Figure 19:
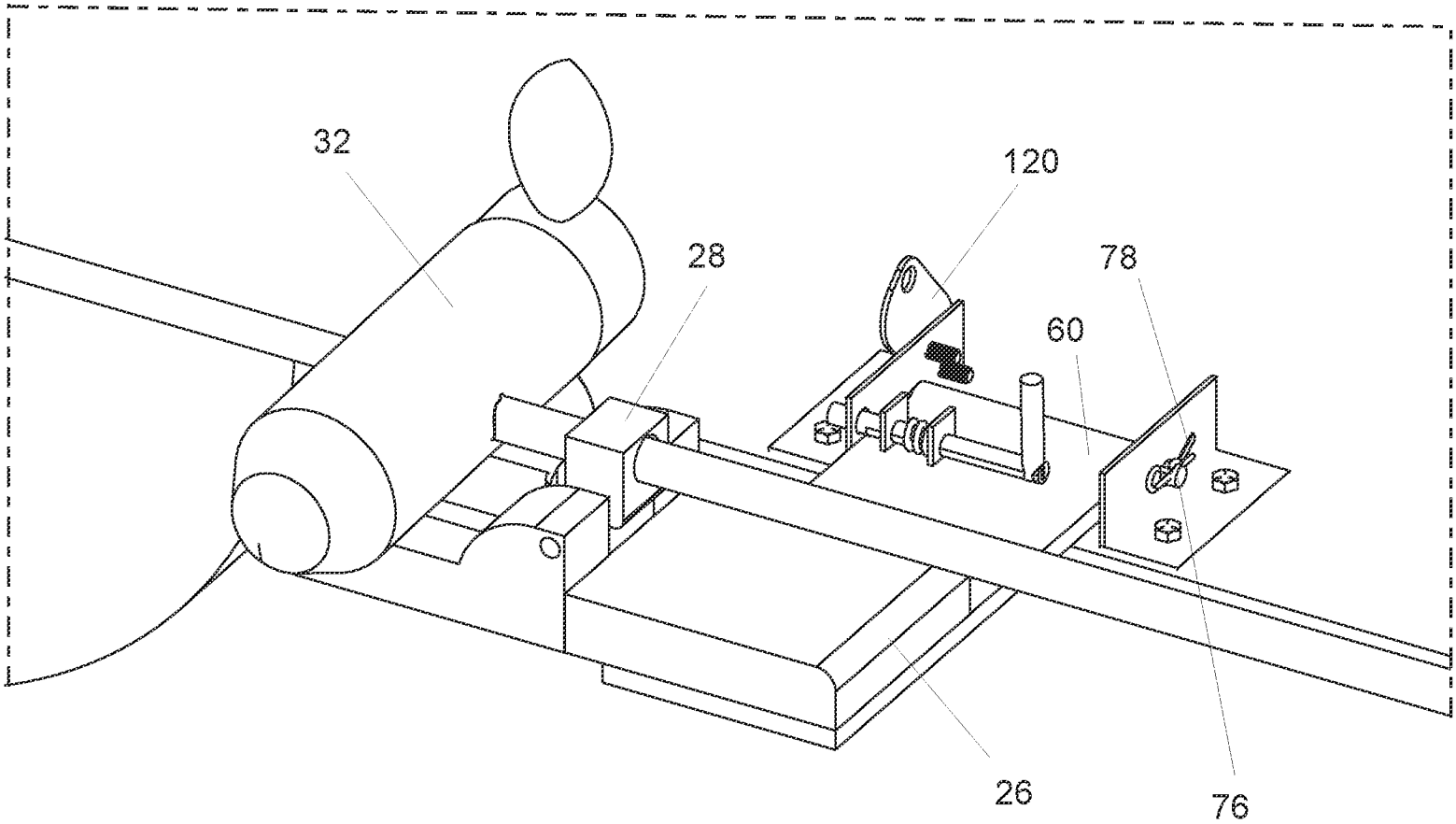
FIG. 19 is a partial sectional front perspective view of a pontoon boat having a trolling motor mount attached to a secondary mount that is fixed to a deck of the pontoon boat in accordance with aspects of the present invention and illustrating the trolling motor orientation when changing locations on a lake.
Figure 20:
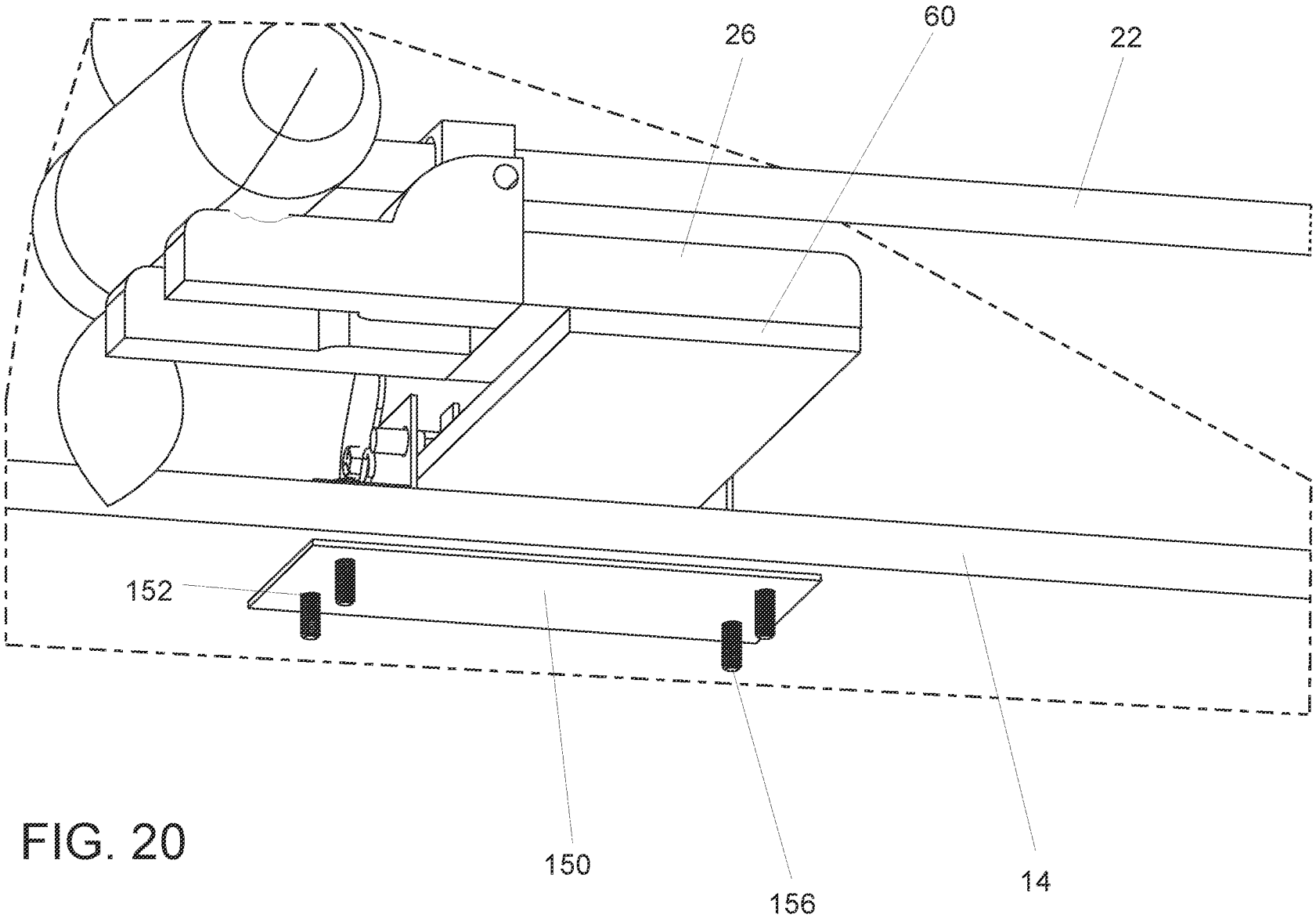
FIG. 20 is a partial sectional bottom perspective view of a pontoon boat having a trolling motor mount attached to a secondary mount that is fixed to a deck of the pontoon boat in accordance with aspects of the present invention and illustrating the trolling motor orientation when changing locations on a lake.
Figure 21:
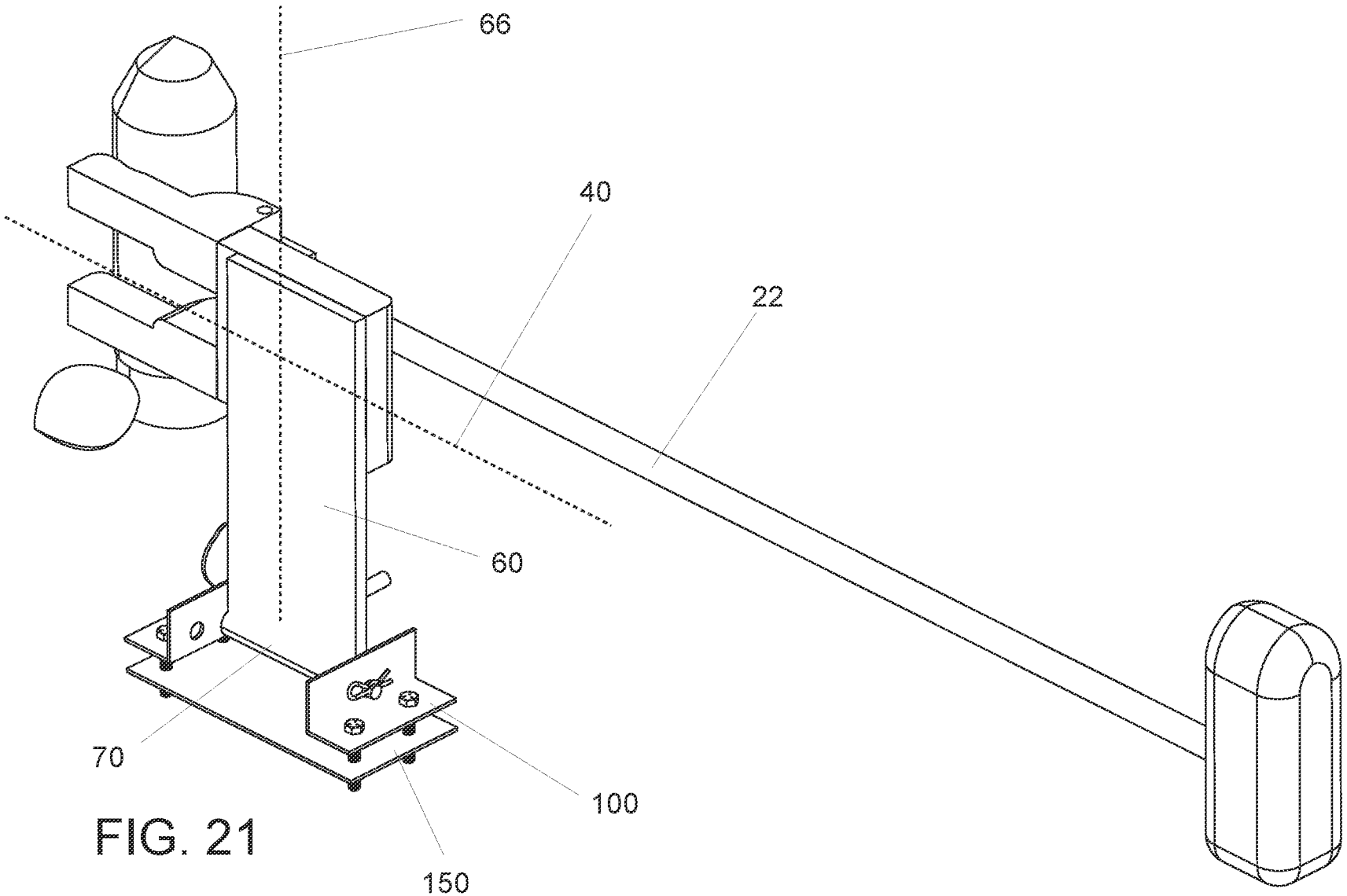
FIG. 21 is a front perspective view of a pontoon trolling motor mount attached to a secondary mount in accordance with aspects of the present invention and illustrating the trolling motor orientation when trailering the pontoon boat.
Figure 22:
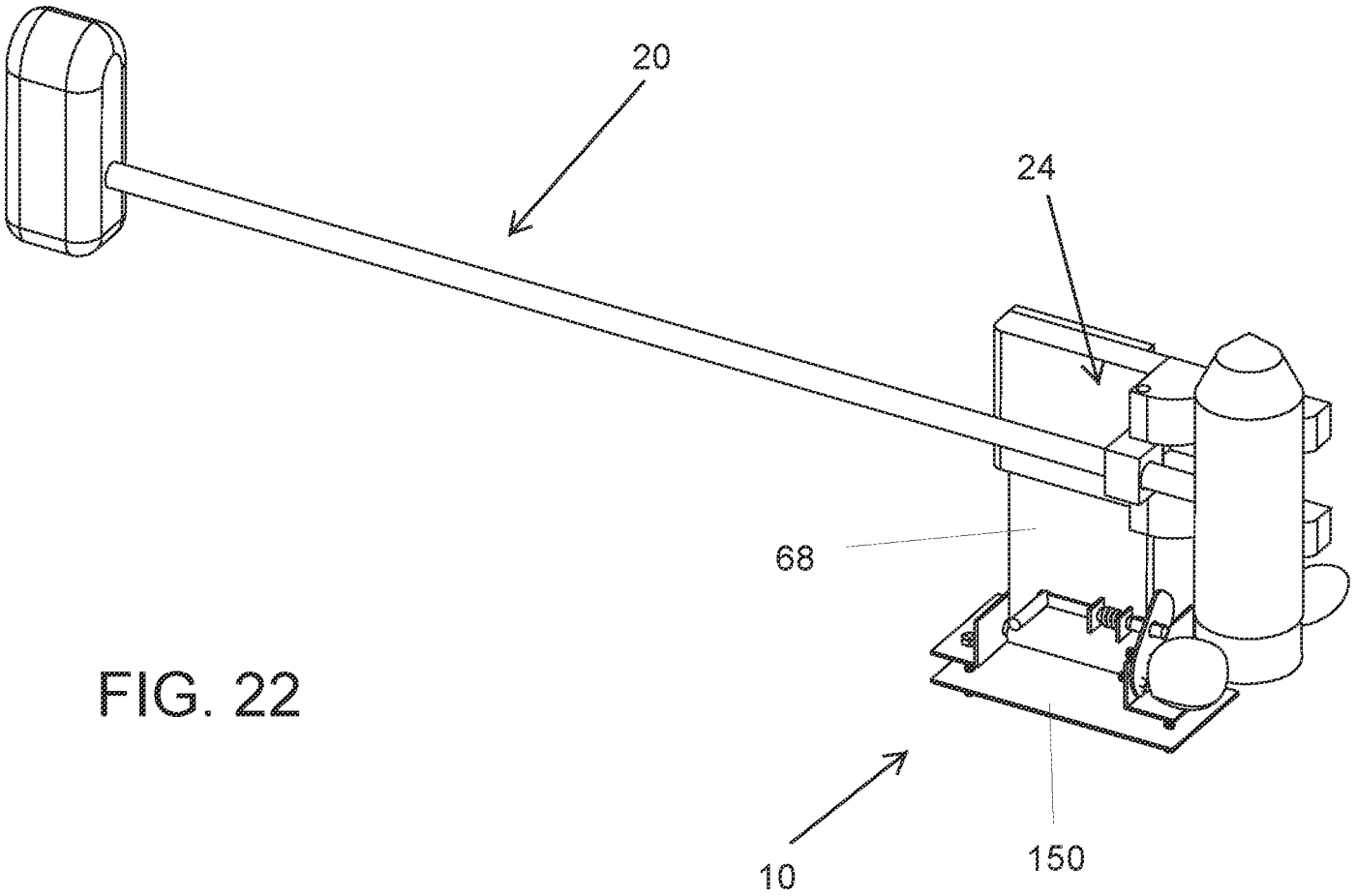
FIG. 22 is a back perspective view of a pontoon trolling motor mount attached to a secondary mount in accordance with aspects of the present invention and illustrating the trolling motor orientation when trailering the pontoon boat.
Figure 23:
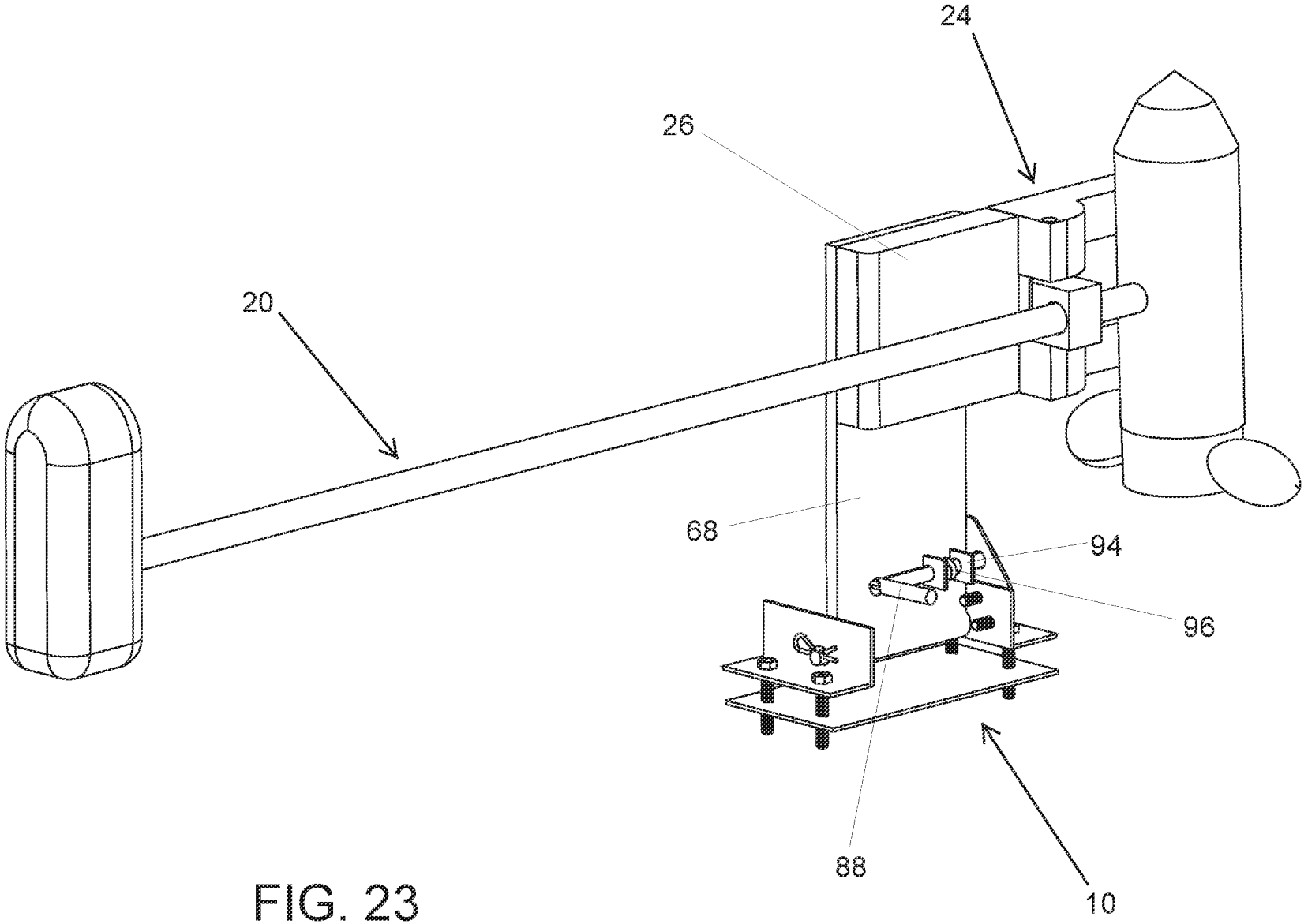
FIG. 23 is a back side perspective view of a pontoon trolling motor mount attached to a secondary mount in accordance with aspects of the present invention and illustrating the trolling motor orientation when trailering the pontoon boat.

FIGS. 1-3 generally illustrates a pontoon boat 12 including a rail that divides the deck into an enclosed area and a front open squared off bow 14. A gate 16 provides an entry point into the enclosed area from the open bow deck 14. Navigation lights 46 and 48 are often mounted on the front most sides of the front end of the squared off deck portion 14. A trolling motor 20 is preferably mounted between the navigation lights so that the trolling motor may be rotated off the front end of the deck 14 into the water. Previously, the gate 16 would be required to be opened so that the trolling motor 20 could be rotated out of the water and extend into the enclosed area. In accordance with aspects of the invention the secondary mount 10 of the present invention allows the trolling motor to be rotated out of the water such that the drive shaft 22 aligns parallel with the squared off front end of the deck 14.

With reference to FIGS. 4-5 and 8-11 the trolling motor mount 24 and secondary mount 10 will be described in greater detail. Typically, a trolling motor 20 includes a drive shaft 22 interconnecting a control head 34 and propeller motor housing 32. Shaft 22 is sufficiently long to allow the trolling motor 20 to be mounted on the bow of a boat and extend into the water a sufficient distance to propel the boat. A motor clamp 28 is clamped to the shaft. When the motor 20 is not in use, the trolling motor mount 24 includes a base or first plate 26 and the clamp or second plate 28 that are pivotally interconnected at a pivot 30. The motor clamp 28 sliding attaches to the shaft 22 such that the shaft may be rotated about a pivot axis 44 and through a plane 42 that aligns with the lengthwise axis 40 of the trolling motor base 26.

The trolling motor secondary mount 10 includes a base plate 60 and deck plate 100. The base plate 60 has a top planar surface 68 that is aligned 62 to an edge of the trolling motor base plate 26. The base plate has a lengthwise axis 66 that is oriented perpendicular to the lengthwise axis 40 of the trolling motor mount 24. An opposing end of the base plate includes a pivot receptacle 70 that is adapted for receiving a pivot pin 76. The pivot pin is further rotationally fixed to the deck plate 100 with quick release keys 78. In this manner, when the deck plate 100 is fastened or fixed to the deck 14 of the pontoon boat 12, the base plate 60 rotates about pin 76. The deck plate 100 includes a pocket defined by opposing sidewalls which are adapted for receiving an end of the base plate 60. The deck plate 100 includes apertures or attachment points that are adapted for receiving a bolt or fastener 156 therethrough. Backing plate 150 includes apertures 154 that align with the deck plate apertures 106 when the deck plate is positioned on the top side of the deck 14 and the backing plate is positioned under the deck 14. Fasteners 156 are use to bolt or fix the deck plate to a front edge at a mid-section of the squared off front bow of the pontoon 12. The deck 14 is sandwiched between the deck plate 100 and backing plate 150. The deck plate 100 further includes a first horizontal lock portion 110 which includes a first aperture 112 and a second vertical lock portion 120 having a second aperture 122 associated therewith.

Base plate 60 has mount 94 fixed thereto. Quick release lever 86 extends through the mount 94 and actuates via spring 96. Quick release lever 86 includes a grip end 88 and engagement tip 90. The engagement tip 90 is adapted to engage with the first and second apertures 112 and 122 formed in a side of the dec plate 100. When the base plate 60 is oriented in the horizontal position the engagement tip 90 extends into aperture 112 and when the base plate 60 is oriented in the vertical position the engagement tip 90 ends into aperture 122. Grip 88 is pulled against compression spring 96 to disengage the tip 90 with the apertures.

As illustrated in FIGS. 2-7, cover 190 conceals components of the secondary mount 10 when the cover is closed over the base 60. The cover includes hinges 190 that are fixed to the cover and a portion of the base plate 60. The cover further includes a relief or recess that provides access to the quick release lever 86 when the cover is rotated over the deck plate 100.

As mentioned above, and with reference to FIGS. 12-16 and 17-23, the present invention provides a method of mounting troller motor 20 to the front squared off deck portion 14 of the pontoon boat 12 such that when the trolling motor 20 is positioned in the stored position the length of the drive shaft 22 of the trolling motor 20 aligns parallel with the squared off end of the bow 14, rather than extending through gate 16 and into the interior of the pontoon (see FIGS. 15-16 and 21-23). The method utilizes secondary mount 10 that includes a base plate 60 adapted for mounting to a bottom of a trolling motor mount 24, whereby a longitudinal axis 66 of the base plate is aligned perpendicular to a length axis 40 of the trolling motor mount 24. Deck plate 100 is rotationally coupled to the base plate 60, wherein the deck plate 100 is adapted to attach to deck 14 of pontoon boat 12. Backing plate 150 is oriented under the deck 14 of the pontoon boat 12, whereby the backing plate 150 is adapted to couple to the deck plate 100. First portion 110 of deck plate 100 is adapted for locking a top planar surface 68 of the base plate 60 in a horizontal position relative to the deck plate 100. Second portion 120 of the deck plate 100 is adapted for locking the top planar surface 68 of the base plate 60 in a vertical position relative to the deck plate 100. Quick release lever 86 is adapted to engage and disengage with the first and second member portions 110 and 120.

Once the user has obtained a trolling motor 20 having a mounting base 26 that includes a first section or base 26 having a longitudinal axis 40 wherein the first section mounts to the secondary mount 10 fixed to the pontoon boat 12. The motor mount further includes a second section or clamp 28 having a longitudinal axis 42, wherein the first section 26 and second section 28 are rotationally coupled at a pivot 30 such that the longitudinal axis of the second plate rotates along the longitudinal axis of the first section. Once the user obtains a secondary mount apparatus 10 for the trolling motor mount 24, the user mounts the deck plate 100 of the secondary mount apparatus 10 to the bow 14 of the pontoon boat 12. The first section or base 26 of the trolling motor is fixed to the base plate 60 of the secondary mount 10. The longitudinal axis 40 of the first section 26 of the mounting base 24 of the trolling motor 20 is aligned perpendicular to the longitudinal axis 66 of the base plate 60. A cover may be hinge mounted to the deck plate 100 whereby the cover 190 at least partially encloses the deck plate 100, first member 110, second member 120, and quick release lever 86. Additionally, the deck plate 100 may be rotationally coupled to the base plate 60 with a quick disconnect rotation pin 76. Also, a spring 96 may be utilized to actuate quick release lever 86 between a locking or engaged position and a disconnect or disengaged position.

Once the trolling motor 20 is mounted to the base plate 60, the user may disengage the quick release lever 86 to rotate the base plate 60 between the stowed position (FIGS. 15-16 and 21-23) and boating position (FIGS. 13-14 and 19-20). When in the boating position, a portion of the base plate extends out past the front edge of the squared off front of the pontoon boat (see FIGS. 13-14 and 19-20). Also, when in the boating position, the trolling motor shaft 22 is elevated above the water in a horizontal position beyond the front walkway 14 of the pontoon 12. In this manner, the trolling motor 20 may be oriented out of the water without extending through the gate 16 and into the boat deck area. The trolling motor 20 may be rotated and lowered to position the trolling motor propeller housing 32 in the water (see FIGS. 12 and 17-18).

These and various other aspects and features of the invention are described with the intent to be illustrative, and not restrictive. This invention has been described herein with detail in order to comply with the patent statutes and to provide those skilled in the art with information needed to apply the novel principles and to construct and use such specialized components as are required. It is to be understood, however, that the invention can be carried out by specifically different constructions, and that various modifications, both as to the construction and operating procedures, can be accomplished without departing from the scope of the invention. Further, in the appended claims, the transitional terms comprising and including are used in the open-ended sense in that elements in addition to those enumerated may also be present. Other examples will be apparent to those of skill in the art upon reviewing this document.

The following claims are incorporated into this description.

The invention claimed is:

1. A secondary mount apparatus for a trolling motor mount, the apparatus comprising:

a base plate configured to fix to a bottom of a trolling motor mount, wherein a longitudinal axis of the base plate is aligned perpendicular to a length axis of the trolling motor mount;

a deck plate rotationally coupled to the base plate, wherein the deck plate is configured to attach to a deck of a boat having a squared off front end;

a backing plate oriented under the deck of the boat, wherein the backing plate is configured to couple to the deck plate;

a first member configured to lock a top planar surface of the base plate in a horizontal position relative to the deck plate;

a second member configured to lock the top planar surface of the base plate in a vertical position relative to the deck plate; and a quick release lever that is configured to engage and disengage with the first and second members.

2. The apparatus as recited in claim 1, further including a cover that at least partially encloses the deck plate, first member, second member, and quick release lever.

3. The apparatus as recited in claim 1, wherein the deck plate is rotationally coupled to the base plate with a quick disconnect rotation pin.

4. The apparatus as recited in claim 3, wherein the quick release lever is spring actuated.

5. The apparatus as recited in claim 1, wherein a portion of the deck plate engages opposing sides of the base plate.

6. A method of mounting a trolling motor to a bow of a boat having a squared off front end, the method comprising the steps of:

obtaining a trolling motor having a trolling motor mounting base that includes a first section having a longitudinal axis wherein the first section is mountable to a boat and the trolling motor mounting base including a second section configured for mounting to a trolling motor shaft of the trolling motor and the second section having a longitudinal axis, wherein the first section and second section are rotationally coupled such that the longitudinal axis of the second section rotates along the longitudinal axis of the first section;

obtaining a secondary mount apparatus for a trolling motor mount, wherein the secondary mount includes:

a base plate configured to mount to a bottom of the first section of the trolling motor mounting base;

a deck plate rotationally coupled to the base plate, wherein the deck plate is configured to attach to a deck of the boat;

a backing plate oriented under the deck of the boat, wherein the backing plate is configured to couple to the deck plate;

a first member configured to lock a top planar surface of the base plate in a horizontal position relative to the deck plate;

a second member configured to lock the top planar surface of the base plate in a vertical position relative to the deck plate; and a quick release lever that is configured to engage and disengage with the first and second members;

mounting the deck plate of the secondary mount apparatus to the deck at a mid-portion of the bow of the boat; and mounting the first section of the trolling motor mounting base of the trolling motor to the base plate of the secondary mount apparatus wherein the longitudinal axis of the first section of the trolling motor mounting base of the trolling motor is aligned perpendicular to the longitudinal axis of the base plate.

7. The method as recited in claim 6, further including the step of mounting a cover to the deck plate wherein the cover at least partially encloses the deck plate, first member, second member, and quick release lever.

8. The method as recited in claim 6, further including the step of rotationally coupling the deck plate to the base plate with a quick disconnect rotation pin.

9. The method as recited in claim 8, further including the step of utilizing a spring actuated quick release lever.

10. The method as recited in claim 6, further including the step of sandwiching the deck of the boat between the deck plate and backing plate.

* * * * *